US010871341B2

(12) United States Patent
Makarov et al.

(10) Patent No.: US 10,871,341 B2
(45) Date of Patent: Dec. 22, 2020

(54) UNIVERSAL PERCUSSION TRIGGER MECHANISM FOR FIREARMS

(71) Applicants: Oleksii Oleksandrovych Sharkov, m. Kyiv (UA); Georgii Georgiiovych Makarov, m. Kyiv (UA); Hlib Georgiiovych Makarov, m. Kyiv (UA); Kostiantyn Okrevych Trypolskyi, m. Kyiv (UA); Serhii Anatoliiovych Babenko, m. Dnipro (UA); Sergii Pavlovych Zibrov, m. Kyiv (UA)

(72) Inventors: Georgii Georgiiovych Makarov, m. Kyiv (UA); Hlib Georgiiovych Makarov, m. Kyiv (UA); Kostiantyn Okrevych Trypolskyi, m. Kyiv (UA); Serhii Anatoliiovych Babenko, m. Dnipro (UA); Sergii Pavlovych Zibrov, m. Kyiv (UA); Oleksandr Kostiantynovych Sharkov, m. Kyiv (UA)

( * ) Notice: Subject to any disclaimer, the term of this patent is extended or adjusted under 35 U.S.C. 154(b) by 0 days.

(21) Appl. No.: 16/492,415

(22) PCT Filed: Mar. 17, 2017

(86) PCT No.: PCT/UA2017/000029

§ 371 (c)(1),
(2) Date: Sep. 9, 2019

(87) PCT Pub. No.: WO2018/164650

PCT Pub. Date: Sep. 13, 2018

(65) Prior Publication Data

US 2020/0041224 A1 Feb. 6, 2020

(30) Foreign Application Priority Data

Mar. 10, 2017 (UA) ..... 201702219

(51) Int. Cl.
*F41A 19/45* (2006.01)
*F41A 17/46* (2006.01)
(Continued)

(52) U.S. Cl.
CPC ..... *F41A 19/45* (2013.01); *F41A 17/46* (2013.01); *F41A 19/16* (2013.01); *F41A 19/47* (2013.01)

(58) Field of Classification Search
CPC .. F41A 9/61; F41A 17/46; F41A 19/16; F41A 19/45; F41A 19/47
(Continued)

(56) References Cited

U.S. PATENT DOCUMENTS

2013/0340309 A1* 12/2013 Lee ..... F41A 19/16 42/69.01
2014/0373418 A1* 12/2014 Hu ..... F41A 19/06 42/69.03
(Continued)

FOREIGN PATENT DOCUMENTS

RU 2 074 350 C1 2/1997
RU 2 090 818 C1 9/1997
(Continued)

OTHER PUBLICATIONS

International Search Report dated Nov. 16, 2017, issued in counterpart International Application No. PCT/UA2017/000029 (1 page).

*Primary Examiner* — Bret Hayes
(74) *Attorney, Agent, or Firm* — Westerman, Hattori, Daniels & Adrian, LLP

(57) ABSTRACT

A universal percussion trigger mechanism, comprising a trigger housing (22) with a magazine (1), safety catch (3), magazine latch (7), firing pin (8), trigger bar (23), spring (12) of the trigger bar, universal percussion mechanism (38), which is fixed in the receiver (20), and consists of a bracket for universal percussion mechanism (16), cocking piece (17) with a cocking indicator mounted on the axis of the cocking piece (18) and spiral mainsprings (19), sear (11) and a single-shot sear (27).

15 Claims, 46 Drawing Sheets

(51) Int. Cl.
*F41A 19/16* (2006.01)
*F41A 19/47* (2006.01)

(58) Field of Classification Search
USPC ..... 42/69.03; 89/136, 139, 14, 141, 143, 89/144, 146
See application file for complete search history.

(56) References Cited

U.S. PATENT DOCUMENTS

| | | | | |
|---|---|---|---|---|
| 2015/0292828 | A1* | 10/2015 | Nebeker | F41A 17/56 42/69.01 |
| 2016/0047615 | A1 | 2/2016 | Tubb | |
| 2016/0161202 | A1* | 6/2016 | Larue | F41A 19/10 42/69.01 |
| 2016/0187092 | A1* | 6/2016 | Mather | F41A 3/66 42/69.02 |
| 2016/0363401 | A1* | 12/2016 | Elftmann | F41A 19/15 |
| 2017/0299309 | A1* | 10/2017 | Fellows | F41A 17/46 |

FOREIGN PATENT DOCUMENTS

| | | | |
|---|---|---|---|
| RU | 2 098 737 | C1 | 12/1997 |
| RU | 90 186 | U1 | 12/2009 |
| RU | 2 472 093 | C2 | 1/2013 |
| RU | 2 525 464 | C2 | 8/2014 |
| UA | 47 344 | C2 | 6/2002 |

* cited by examiner

10/71

1-1

UNIVERSAL PERCUSSION TRIGGER MECHANISM FOR FIREARMS

This invention relates to firearms and can be used in different types of small arms, for example, pistols, submachine guns, automatic rifles, rifles, and machine guns.

The percussion trigger mechanism is known from the prior art (Patent UA No. 47344, IPC F41A 19/00, publ. Sep. 15, 2006, bull. No. 9), which comprises: a firing percussion with a cock platform, firing pin and platform for keeping the latter at a distance outside contact with the cartridge capsule, the safety catch of the firing percussion with the spring, action spring, focus of the action spring, trigger, trigger bar, protrusions of the trigger bar for interacting with the firing pin safety, with the trigger cut-out of the bolt and with the cocking piece of the firing percussion, trigger return mechanism, with cocking piece in use the traveling position with the trigger mechanism spring, the surface of the frame and the trigger bar providing the possibility of vertical and longitudinal movement of the latter, sear with the spring and the mechanism of safe trigger of the firing pin, in which the protrusions are made to stop the firing percussion and safe trigger. To increase the convenience and accuracy of firing, the percussion trigger mechanism of the pistol is additionally equipped with a transmission lever, and a cocking piece protrusion is made on the trigger bar. The transmission lever is installed with the possibility of interaction with the sear, the cocking piece protrusion of the trigger bar and the protrusion of the safe trigger. The sear is installed with the possibility to hold the firing percussion in a fully cocked position.

The disadvantage of said mechanism is that it does not allow, when firing from a weapon, to know about the state of the cocking piece, especially at night, and does not provide visual and tactile determination of the status of the cocking piece.

It is known in the prior art the cocking piece assembly for the percussion trigger mechanism of weapons according to the bull-pup scheme (Patent RU No. 2525464, IPC F41A19/06, F41A19/10, F41C7/00, published on Aug. 20, 2014), containing the trigger, according to the bull-pup scheme connected with a longitudinal rod located inside the receiver with a standard trigger, in which the rod is Z-shaped and placed to the left of the vertical plane passing through the longitudinal axis of the weapon under the power bridge and above the auto-trigger axis and the axis of the barrel trigger housing.

The disadvantage is the complexity of the design when converting a standard percussion trigger mechanism for use in weapons built according to the bull-pup scheme. In addition—an inconvenient disassembly and assembly of the percussion trigger mechanism of this type, as the removal of four axes is required.

It is known in the prior art the percussion trigger mechanism of automatic small arms (Patent RU No. 2472093, IPC F41A19/00, published Jan. 10, 2013) containing a cocking piece with a cocking position and auto-trigger cooking, action spring, spring-loaded sear, kinematically connected with the trigger; a single-shot sear and spring-loaded auto-trigger with a self-trigger sear with two contact surfaces holding the cocking piece auto-trigger when reloading the weapon and after the shot, in which the portions of the percussion trigger mechanism are placed in a single case fixed in the weapon bed; the cocking piece auto-trigger is displaced relative to the axis of cocking piece rotation toward the head of the cocking piece, an additional auto-trigger is introduced, and it is mounted on the axis of the sear together with the auto-trigger and unilaterally coupled with it with the possibility of joint rotation when the lock frame interacts with the auto-trigger lever, and independent of each other rotation at interaction with the side surface of the cocking auto-trigger cocking piece, and the contact surface of the sear of the additional auto-trigger is parallel to the similar surface of the auto-trigger sear and is shifted in the direction of rotation of the cocking piece when cocking after firing.

The disadvantage of this technical solution is the lack of a tangible effect of the spring-loaded trigger on a shooter finger of the arrow when releasing the trigger.

The percussion trigger mechanism of automatic weapons is also known (Patent RU No. 2525339, IPC F41A19/00, F41A19/06, F41A19/07, published on Aug. 10, 2014) containing a sear with a trigger axis, single-shot sear mounted on the axis of the cocking piece; cocking piece with a cocked position and a spring-loaded auto-trigger cooking, action spring, cocking piece axis, spring-loaded auto-trigger with a sear and spring-loaded auto-trigger axis, in which the trigger is made in the form of L-shaped lever with a step-shaped position with the possibility to interact with spring-loaded U-shaped auto-trigger whose axis is located between the axis of the trigger and the axis of the cocking piece.

The disadvantages of this technical solution are:

- the impossibility to adjust the trigger bar;
- lack of trigger with alarm;
- the complexity of the design, consisting of a large number of portions of complex configuration;
- inconvenient disassembly and assembly of the trigger mechanism—requires the removal of three axes under the influence of the springs;
- the mechanism does not allow, when firing, to know the state of the cocking piece cocking, especially at night, and does not provide a visual and tactile determination of the status of the cocking piece cocking;
- the rotation angles of the auto-trigger sear are small, and because of this, small overlaps occur between the cocking piece and the auto-trigger sear, as resulted in friction increase, and small surface sections at the contact points wear out quickly. All this reduces the time of use of the mechanism and reduces the reliability of the percussion trigger mechanism, especially under difficult operating conditions (dust, dirt, sand, etc.);
- the mechanism does not allow using it without significant changes in various types of small arms (for example, weapons with a magazine in a pistol grip; weapons made according to the bullpup scheme; weapons made with a side firing handle, etc.).

Unlike the above models, the proposed universal percussion trigger mechanism allows to improve the operation and reliability of the weapon and increase its operational characteristics. In particular: the reliability of safety catch is increased, it is possible to visually and tactually determine the state of the cocking piece, it is possible to adjust the cocking piece force and prevent the moment of trigger when firing, as well as the impossibility of cocking the weapon when the safety catch is in the safety position, removing the auto-trigger device from the weapon by transferring this function to the multifunctional switch.

This feature ensures the multifunctionality of the entire mechanism, that is, makes it possible to use it for weapons with a magazine in a pistol grip, in weapons made according to the "bull-pup" scheme, and weapons made with a side firing handle, which at the same time creates additional usability and the reliability of the magazine latch.

The technical result that is achieved at implementation of the present invention, is the possibility to provide adjustment of the effort of trigger and to prevent accidental shots.

The specified technical result is achieved by means of the following:

a universal percussion trigger mechanism is proposed, which comprises:

a trigger housing (22) with a magazine (1) made with a locking protrusion (2) interacting with the magazine latch (7);

a safety catch (3), spring-loaded through the safety latch (4) by the safety latch spring (5), which is located in the trigger housing (22), and is configured to reciprocate;

magazine latch (7), which is rotatable and spring-loaded through the magazine pusher (6) with the safety latch spring (5);

a firing pin (8), spring-loaded with firing pin spring (9), and fixed by a firing pin locker (10) in the shutter housing (15), and configured to reciprocate when the cocking piece (17) is acted upon;

a trigger bar (23), made together with the sear (11), which, under the influence of the spring (12), has the possibility to reciprocate in the trigger housing (22), inside which is located, the single-shot sear (27) and spring-loaded with spring (30) of the trigger mechanism;

a spring (12) of the trigger bar, which is made with the possibility to compress and expand due to the adjusting screw (13), which is installed in the trigger housing (22), and fixed with a lock nut (14);

a universal percussion mechanism (38), which is fixed in the receiver (20), and consists of a bracket (16) for a universal percussion mechanism, cocking piece (17) with a cocking indicator (18) mounted on the axis of the cocking piece and mainsprings (19), wherein the specified cocking piece (17) is spring-loaded with mainsprings (19), and interacts with the rear end (33) of the lock frame (31), the sear (11) and the single-shot sear (27), in which according to the invention the safety catch (3) is made in the form of a rectangular rod (64), on the side of which a large slot (65) and a small slot (66) are made, intended to interact with the safety protrusion (85) of the trigger bar (23), in addition, a through triangular slot (67) is made on top of the specified rectangular rod (64), and a protrusion (68) is made at the end of the rectangular rod (64) is made interacting with the trigger housing (22), in addition, two slots (69) are made at the ends of the rectangular rod (64), and two spherical recesses (70) are made on the lower surface of the rectangular rod (64) interacting with a spring-loaded through the safety latch spring (5) the safety latch (4), moreover said safety latch (4) is provided with a spherical head (71) having a cylindrical section (72) which moves in the axis (73) and ends with a cone (74);

the magazine latch (7) is made with a washer (78), lever (79) and a slot (80), and in the center of the washer (78) a rod (81) is made, acting as the axis, on which the magazine latch (7) swings in the trigger housing (22), with a locking protrusion (82) provided to interact with the locking protrusion (2) of the magazine (1), and between the washer (78) and the locking protrusion (82), a protrusion (83) is made interacting with the magazine pusher (6), which is made with a cylindrical portion (75) turning into a washer (76), which passes into the axis (77), and between the cylindrical section (72), the safety latch (4) and the cylindrical section (75) of the magazine pusher (6) a gap (B4) is arranged;

the cocking piece (17) is made with cylindrical protrusions (43) with a through hole (44), consisting of the base of the cocking piece (45), the percussion platform (46) interacting with the firing pin (8) and the bulge (33) at the end of the lock frame (31), cocking piece tail (47) and cocking piece tip (48) interacting with the upper surface of the protrusion (97) of sear (11) and the rear radius surface (109) of a single-shot sear (27), in addition, on the percussion platform (46) below a damper platform (49) is made interacting with the receiver (20), and a protrusion with cock position platform (50) is made on the cocking piece tip (48), interacting with the support platform (98), sear (11), and a protrusion with the platform (51), interacting with the lower horizontal surface (107) of the single-shot sear (27), and in the lower portion of the base of the cocking piece (45) a cocking indicator (52) is made in the form of a thin plate with a notched section (53) and a smooth section (54), and a protrusion (55) interacting with the protrusion (97) is made at the cocking piece tail (47) below the cocked position platform (50) of sear (11);

the sear (11) contains a bar (96), in front of which a protrusion (97) is made at the top, a support platform (98) is made at the bottom of the protrusion (97), and a through hole (99) is made at the side of the sear (11), and the upper surface of the protrusion (97) is made in the form of a radius, in addition, a locking protrusion (100) is made on the rear wall of the bar (96) with the bottom edge;

the single-shot sear (27) contains a square rod (103), on the back of which T-shaped protrusion is made, consisting of a sear section (104) and the rack of the sear (105), and a blind hole (106) is made inside the square rod (103) for the spring of the trigger mechanism (30);

the bracket of the universal percussion mechanism (16) is made in the form of two plates (58) connected with a transverse plate (59) at an acute angle (d59) relative to the horizontal axis of the bracket (16), a hole (60) and hole (61) are made on the plates (58) of different diameters in which the axis of the cocking piece (18) is mounted, made in the form of a cylinder (62) with a slot at the end (63);

the trigger bar (23) is made with a trigger (84) with a safety protrusion (85) interacting with the safety catch (3), with a front protrusion (86) interacting with the trigger housing (22), and the base of the trigger (87) is connected with a thrust (89), which passes into a bar (90), inside of which a rectangular cavity (91) is made, which is designed for single-shot sear (27), and the bar (90) is connected with the protrusion (92), which is connected with the rear protrusion (93), on which a removable sear (11) is put on;

the multifunctional switch (28) containing a trapezoidal bar (110), the front end of the indicated trapezoidal bar (110) is made in the form of a rack (111), which interacts with the hook-shaped protrusion (32) of the lock frame (31), with a horizontal protrusion (112), which interacts with the receiver (20), and in the rear of the trapezoidal bar (110) a T-shaped protrusion is made, consisting of a section of the sear (113) and the rack of the sear (105), and a blind hole (106) is made inside the trapezoidal bar (110) and the multifunctional switch axis (29) is installed, spring-loaded with a spring of the trigger mechanism (30) and the rear bottom surface of the trapezoidal bar (110) is a protrusion (114) acting as a lever of fire;

the axis of the multifunctional switch (29) is made in the form of a conical section (116) with a spherical head (117), and the specified conical section (116) passes into the cylindrical portion (118), which passes into the cylindrical portion (119) with a smaller diameter, which ends with a chamfer (120).

In addition, the trigger bar (24) is made with a trigger (84) with a safety protrusion (85) interacting with the safety catch (3), with a front protrusion (86) interacting with the trigger housing (22), and the base of the trigger (87) is connected with the thrust (89), which passes into the bar (90), and in the upper portion of the bar (90) a rectangular hole (94) is made, inside the bar (90) there is a rectangular cavity (91) with a figured slot (95), containing a multifunctional switch (28) spring-loaded with the spring (30) of the trigger mechanism through the axis of the multifunctional switch (29) of the housing, which is arranged to reciprocate and roll relative to its rear portion, and the bar (90) is connected with the protrusion (92), which is connected with the rear protrusion (93), on which the removable sear (11) is put on.

In addition, the trigger bar (25) is made with the trigger (84) with the safety protrusion (85) interacting with the safety catch (3), with a front protrusion (86) interacting with the trigger housing (22), and the base of the trigger (88) is connected with the thrust (89), which passes into a bar (90), inside which a rectangular cavity (91) is made, which is used for the single-shot sear (27), and the bar (90) is connected with the protrusion (92), which is connected with the rear projection (93), on which a removable sear (11) is put on, in addition the base of the cocking piece (88) is rotated by 90 degrees and located in a vertical plane.

In addition, the trigger bar (26) is made with a trigger (84) with a safety protrusion (85) interacting with the safety catch (3), with a front protrusion (86) interacting with the trigger housing (22), and base of the cocking piece (88) is connected with the thrust (89), which passes into the bar (90), and in the upper portion of the bar (90) a rectangular hole (94) is made, inside the bar (90) there is a rectangular cavity (91) with a figured slot (95), where multifunctional switch (28) is contained, spring-loaded with spring (30) of the trigger mechanism through the axis of the multifunctional switch (29), which is arranged for reciprocating movement and rolling relative to its rear portion, and the bar (90) is connected with the protrusion (92), which is connected with the rear protrusion (93), on which the removable sear (11) is put on, in addition, the base of the cocking piece (88) is rotated at 90 degrees and located in a vertical plane.

In addition, the trigger bar (23) is installed in the trigger housing with a magazine in the pistol grip (22).

In addition, the trigger bar (23) is installed in the trigger housing, made according to the bull-pup scheme (39).

In addition, the trigger bar (24) is installed in the trigger housing with a magazine in the pistol grip (22).

In addition, the trigger bar (24) is installed in the trigger housing, made according to the bull-pup scheme (39).

In addition, the trigger bar (25) is installed in the trigger housing with a side pistol grip (40).

In addition, the trigger bar (26) is installed in the trigger housing with a side pistol grip (40).

In addition, on the protrusion with the cock position platform (50) of the cocking piece (17), a protrusion (56) with an inclined platform (57) is made and on the support platform (98) of the sear (11) a T-shaped protrusion (101) is made with an inclined platform (102).

In addition, at the cocking piece (17), the inclined platform (57) forms an acute angle (d57) with the cock position platform (50) equal to 35-45 degrees.

In addition, the inclined platform (102) of the sear (11) forms an acute angle (d102) with the support platform of the sear (98) equal to 35-45 degrees.

In addition, the acute angle (d57) with the platform of cock position platform (50) of the cocking piece (17) and the acute angle (d102) with the support platform of the sear (98) are made equal.

In addition, the thrust (89) is made of various lengths in the trigger bars (23), (24), (25), (26).

Improving the reliability of the safety catch is achieved by the fact that due to the through slot of the triangular shape of the safety catch, a protrusion is formed at the end of the safety catch, which rests on the trigger housing due to the spring-loaded safety latch and does not allow it to be removed from the safety position by directly pressing the safety catch. To remove the safety catch from the safety position, it is necessary to press the safety catch down additionally and simultaneously push it sideways. This increases the reliability of the safety catch when shaking, dropping weapons and from accidental direct pressing of the safety catch.

The possibility of visual and tactile determination of the state of the cocking piece is achieved by the fact that: when cocked, the cocking indicator in the landing hole of the trigger housing with a pistol grip and forearm a serrated notch plate appears. When the cocking piece is pulled with a cocking indicator, a smooth section of the plate appears in the landing hole of the trigger housing with the pistol grip and forearm.

The possibility to adjust the cocking piece force is achieved by rotating the adjusting screw of the trigger bar spring with a trigger in the receiver. In this case, it is possible to adjust the compression force of the spring of the trigger bar. After setting the necessary compression force of the spring of the trigger bar, it is necessary to lock the lock nut of the adjusting screw and thereby prevent possible changes in the thrust spring force with a cocking piece during subsequent operation of the weapon.

The prevention of an unauthorized trigger moment during a shot is achieved by the fact that the sear with its protrusion with an inclined platform needs to overcome the protrusion with an inclined platform on the cocking piece. The angles of the protrusions with inclined platforms are made equally and, by changing their inclination, it is possible to adjust the safety catch force.

The impossibility to cock a weapon when the safety catch is in the safety position is achieved by the fact that when trying to cock a weapon, the bulge at the rear end of the lock frame abuts the cocking piece. In this case, the protrusion on the cocking piece rests on the sear protrusion and locks the further movement of the lock frame, thereby preventing the cocking of weapons.

Also, the proposed technical solution provides the possibility of removing the auto-trigger device from the weapon, by transferring this function to the multifunctional switch. This is achieved by the fact that in the process of firing a shot, when rolling back the lock frame, a bulge at the rear end of the lock frame cocks the cocking piece. The cocking piece tip hits the rear radial surface of the multifunctional switch and pushes it, compressing the trigger mechanism spring. The protrusion with the cocking piece platform is placed on the lower inclined surface of the multifunctional switch and holds the cock in the cocked position when the trigger bar with trigger is pressed. The lock frame reaches its extreme rear position. When rolling the lock frame, it with its hook-shaped protrusion engages with the rack of the multifunctional switch. With further forward movement of the slide frame, the lower inclined surface of the multifunctional switch disengages from the protrusion of the cocking piece platform. A shot occurs and thereby auto-trigger during the shot.

The multifunctionality of the proposed mechanism is ensured by the fact that this mechanism can be used with a single-shot sear for semi-automatic weapons. And with a multifunctional switch, such a mechanism can be used in automatic weapons, both in single-shot mode and in automatic-fire mode. At the same time, the proposed mechanism can be used without the single-shot sear and without a multifunctional switch for magazine weapons.

In addition, the proposed universal percussion trigger mechanism provides the comfortability of use and reliability of the magazine latch operation. This is achieved by the fact that: the magazine latch is installed in the closed position by the safety latch spring of the magazine latch. Between the pusher of the magazine latch and the receiver there is a gap that allows the magazine latch to rotate only at a certain angle, protecting the magazine latch from spontaneous disassembly.

The essence of the invention is explained by drawings, where:

Figure 17:
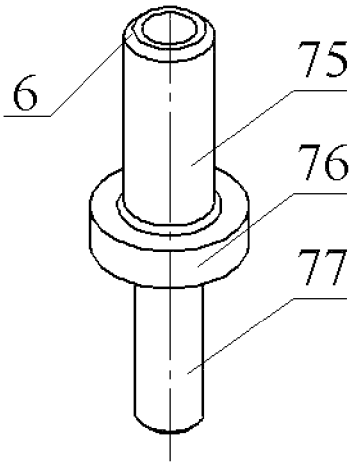
Figure 18:
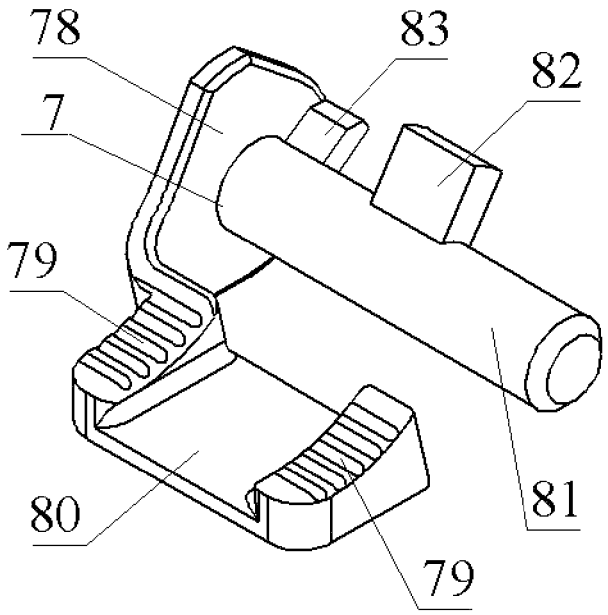
Figure 19:
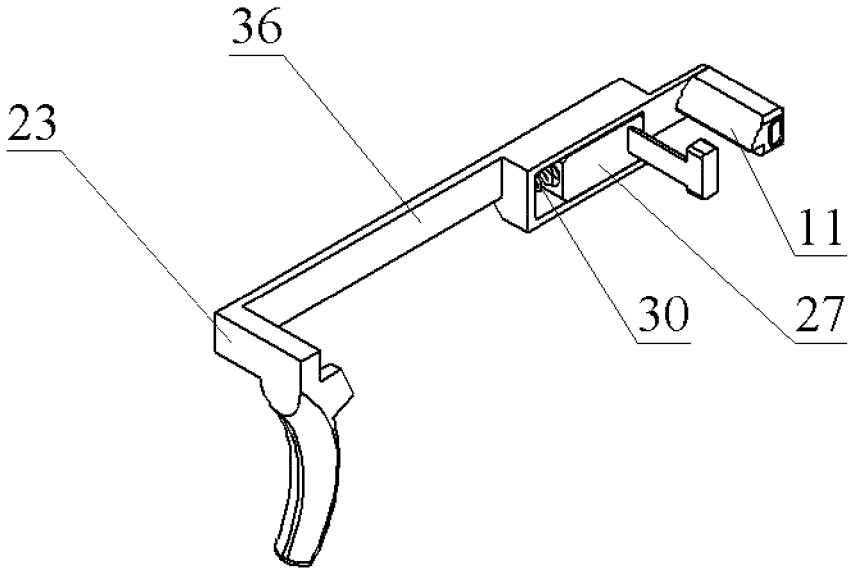
Figure 19A:
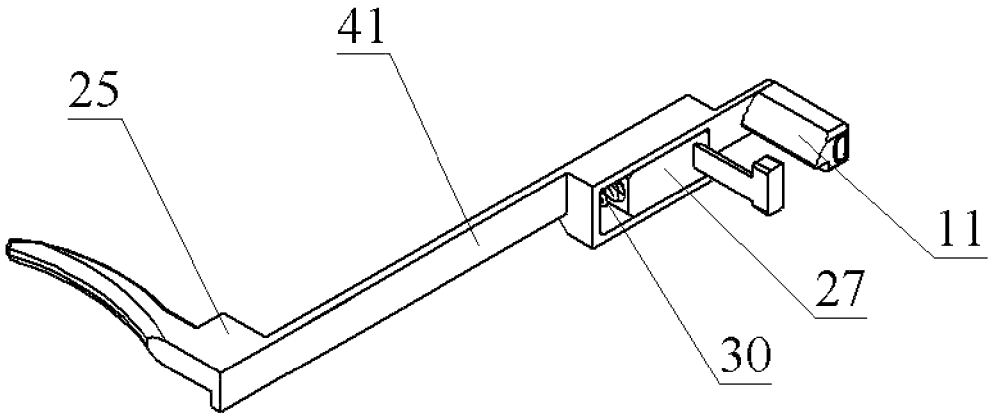
Figure 20:
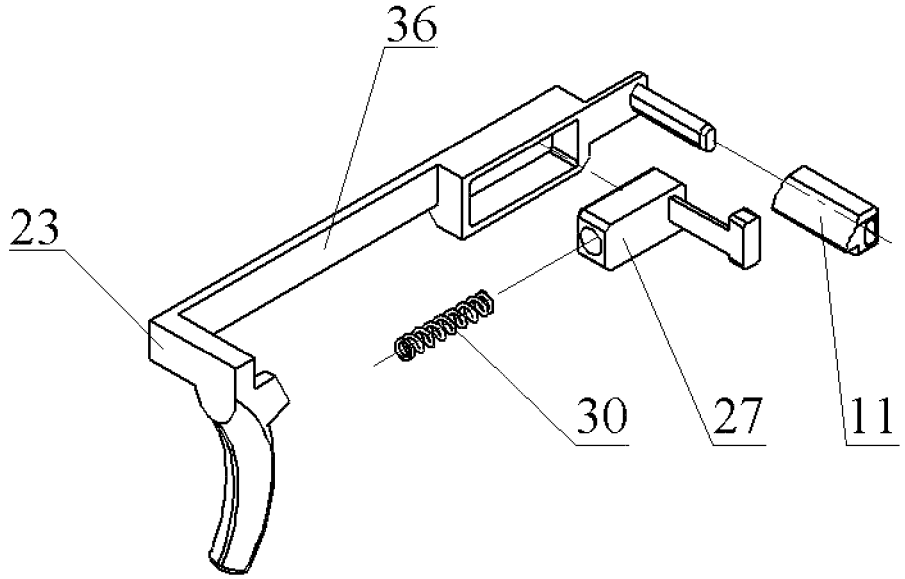
Figure 20A:
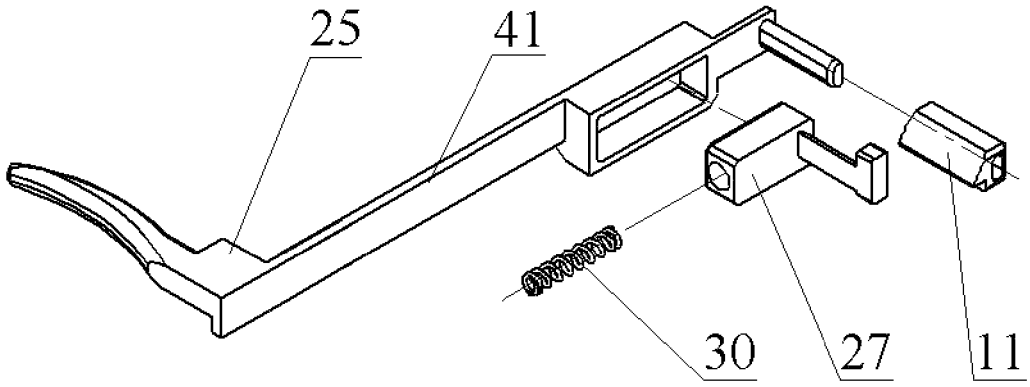
Figure 21:
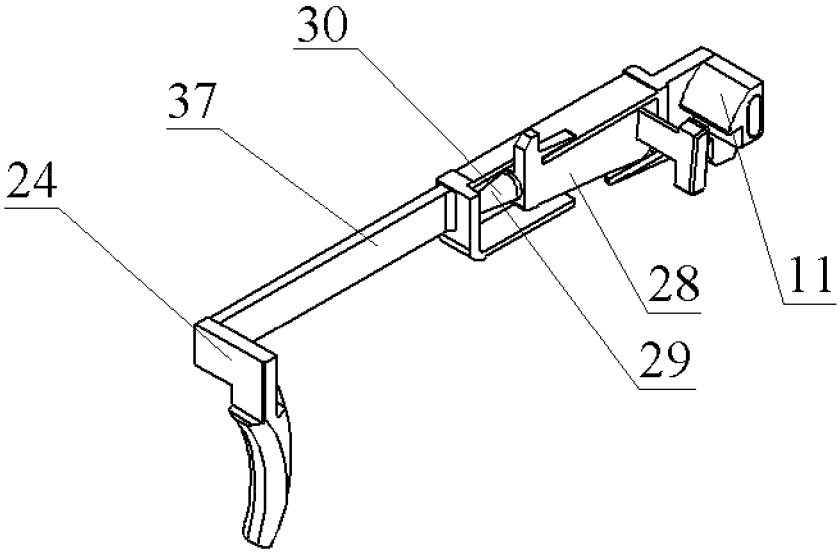
Figure 21A:
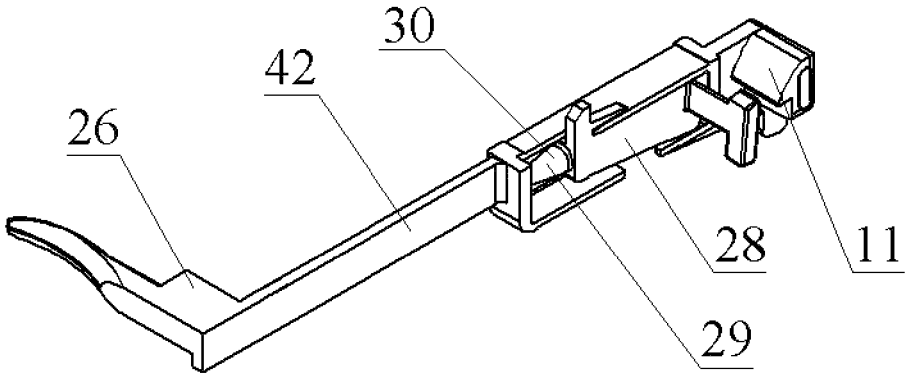
Figure 22:
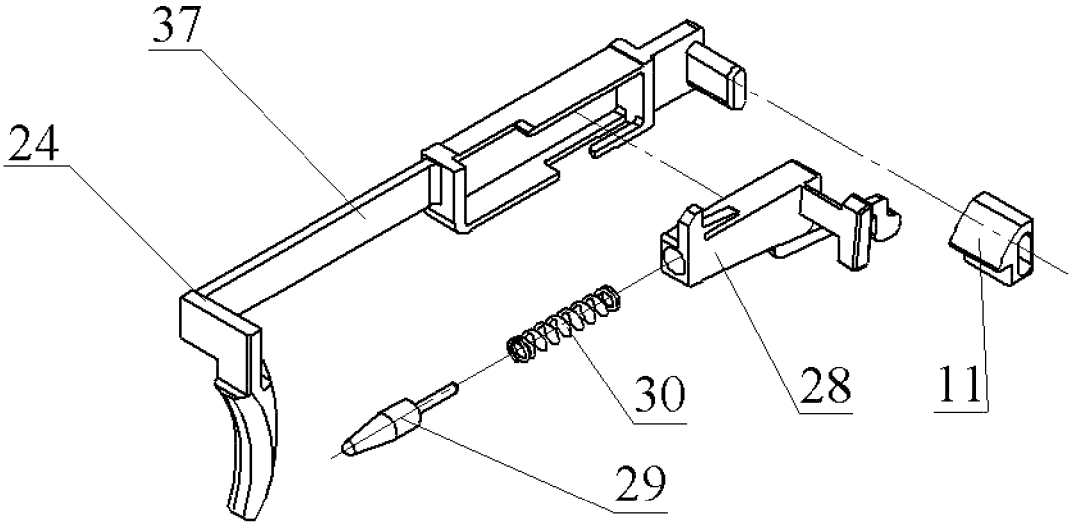
Figure 22A:
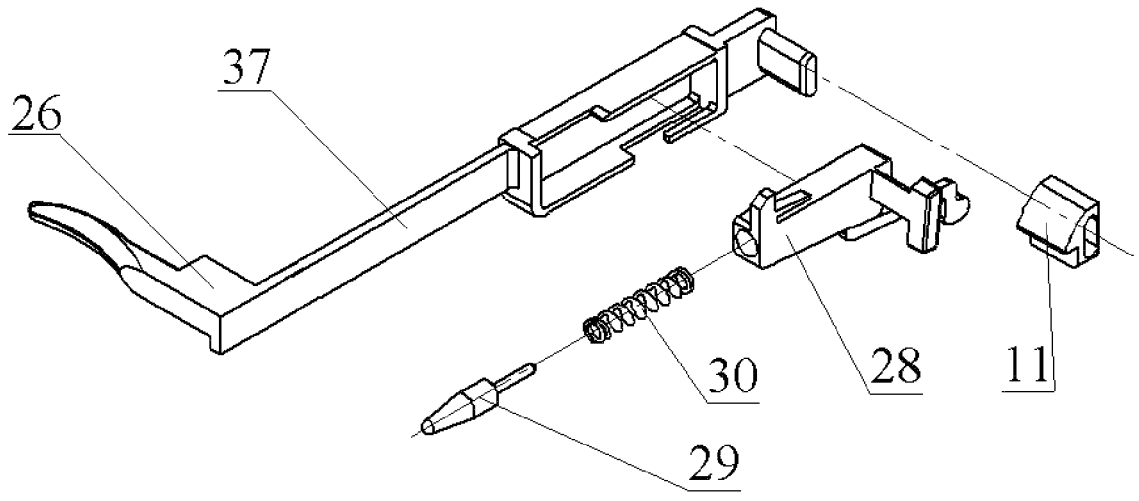
Figure 23:
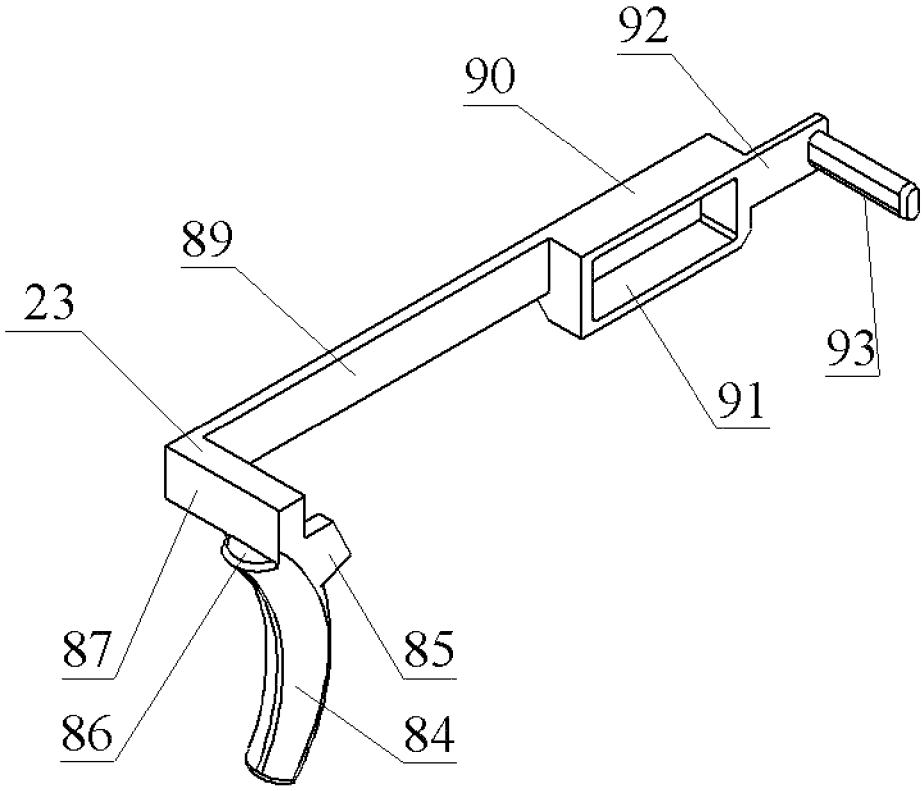
Figure 24:
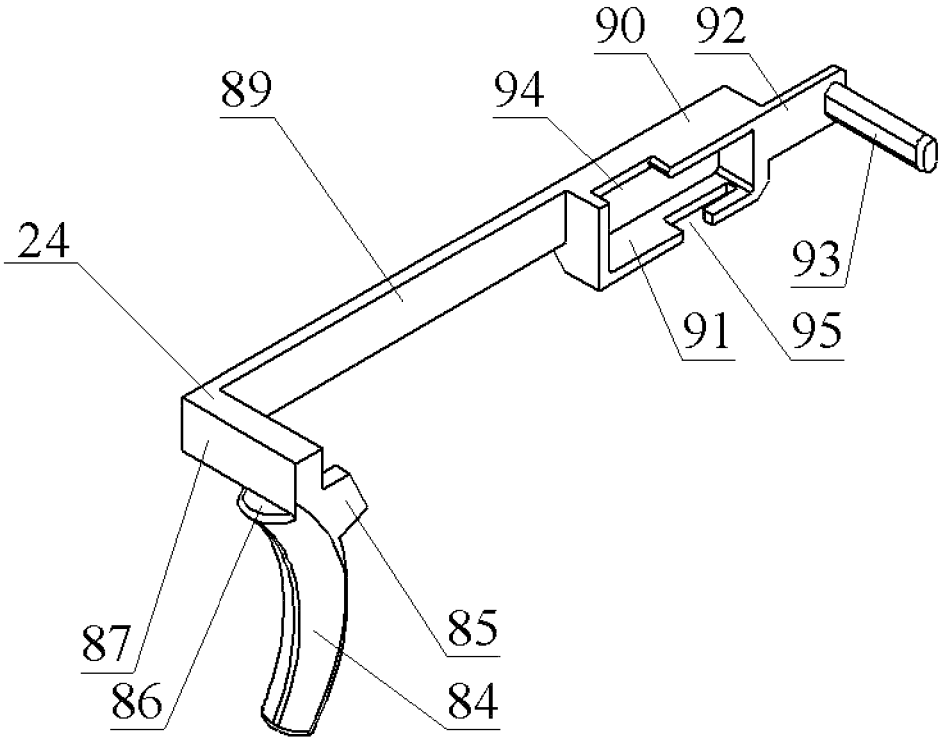
Figure 25:
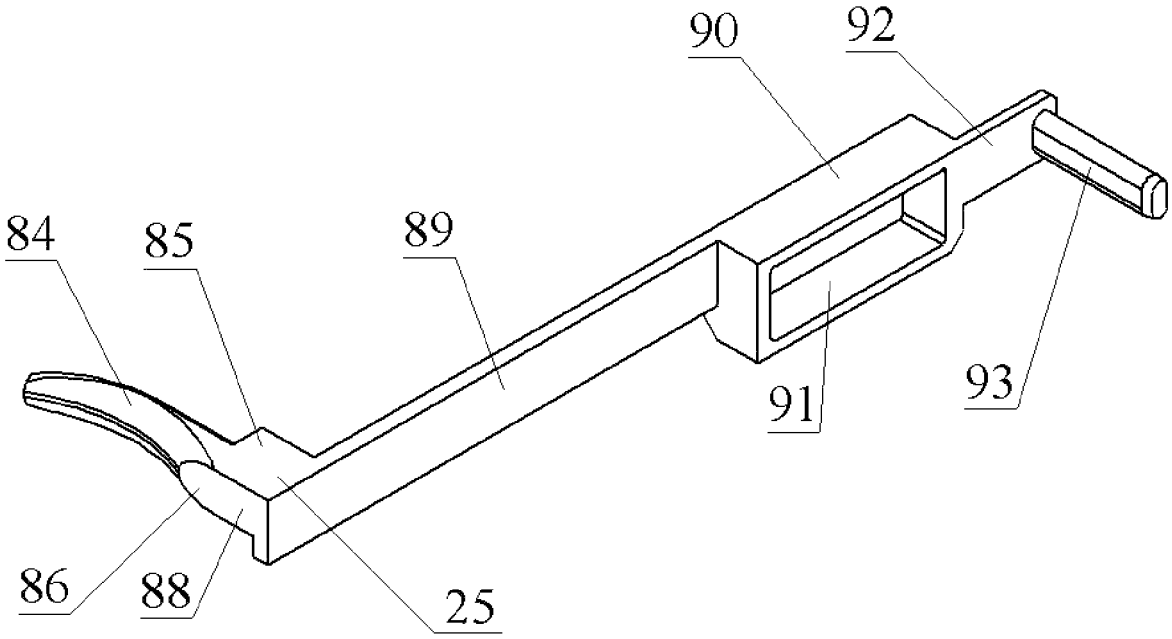
Figure 26:
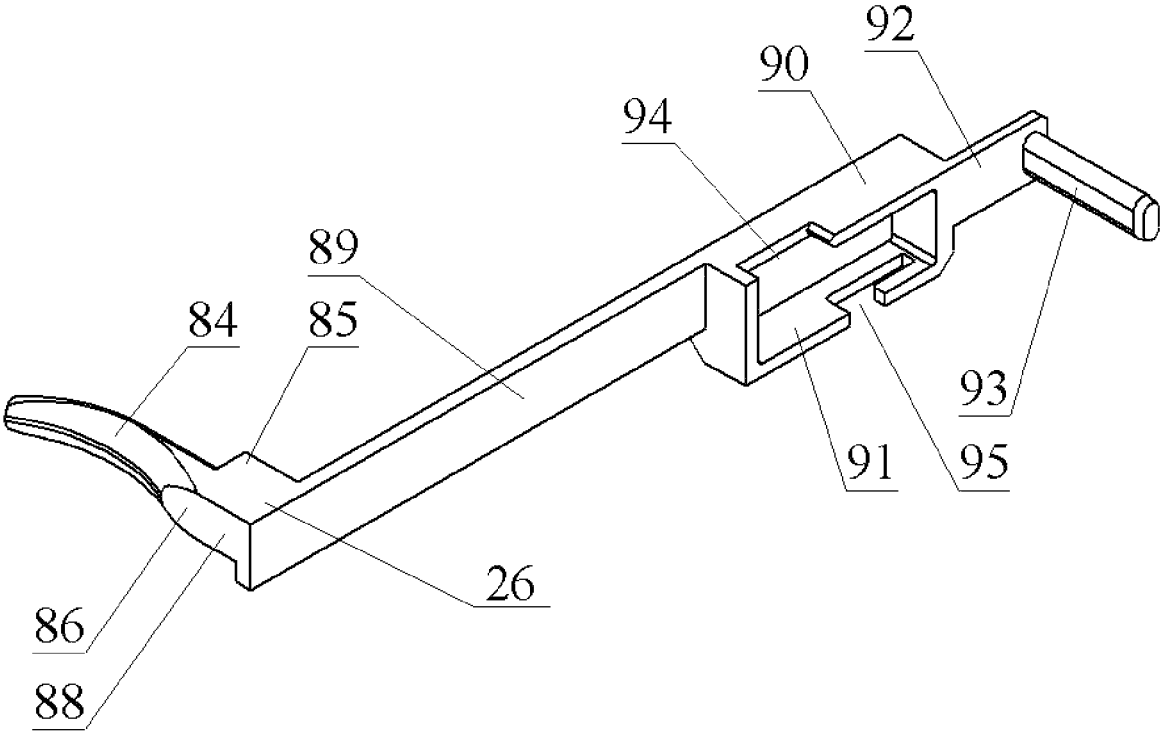
Figure 27:
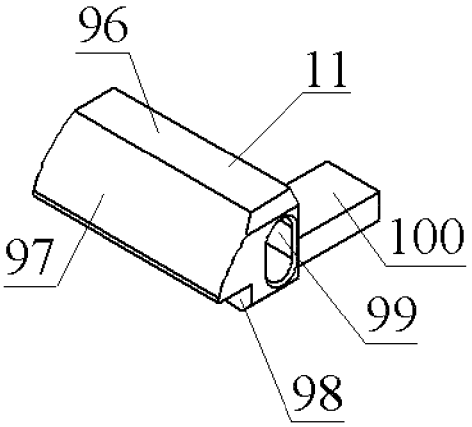
Figure 28:
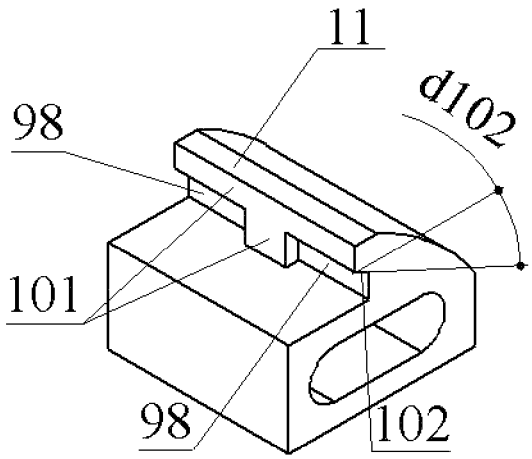
Figure 29:
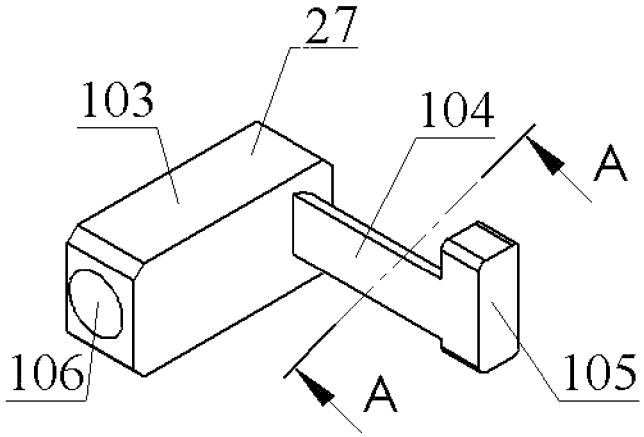
Figure 30:
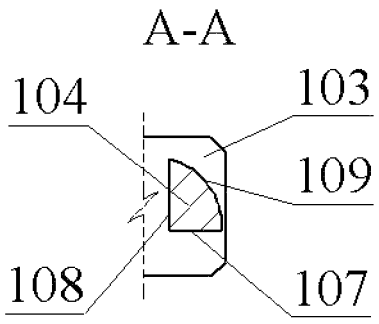
Figure 31:
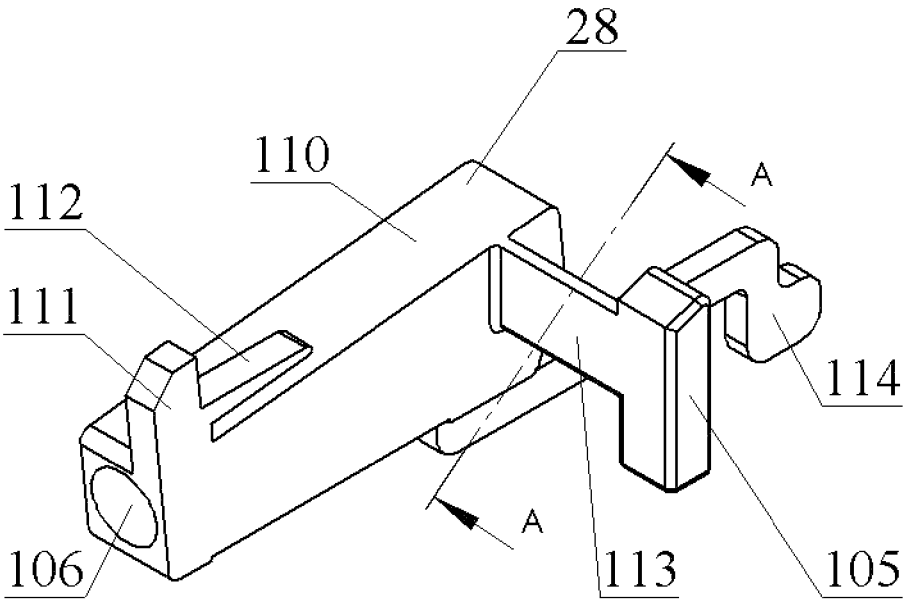
Figure 32:
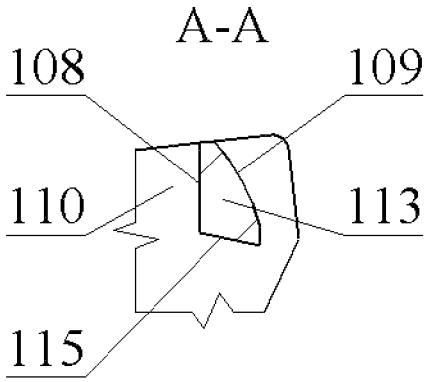
Figure 33:
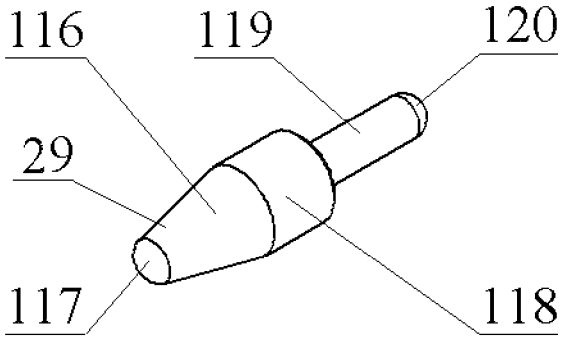
Figure 34:
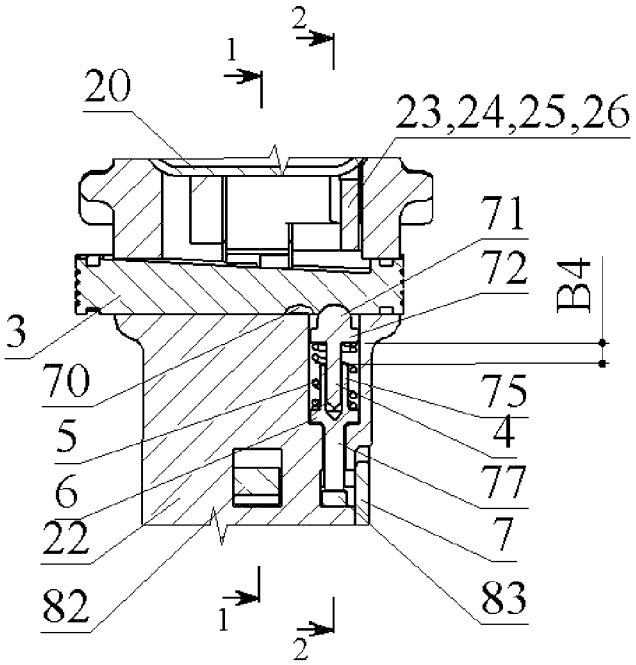
Figure 35:
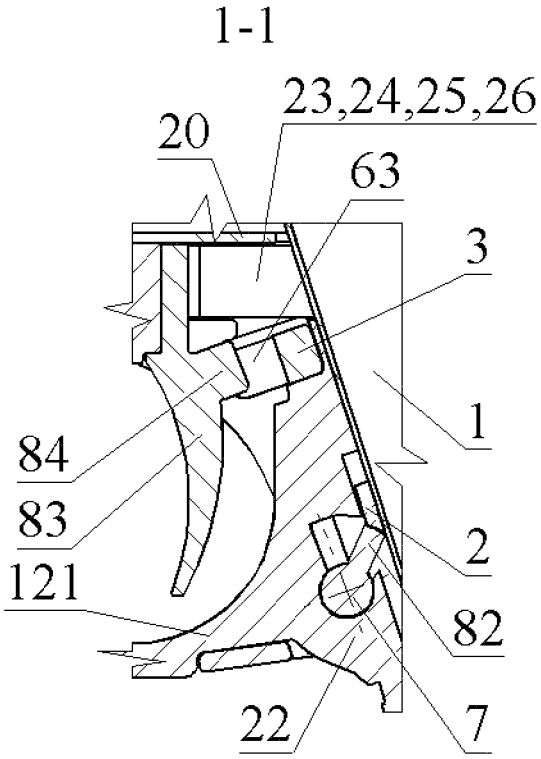
Figure 36:
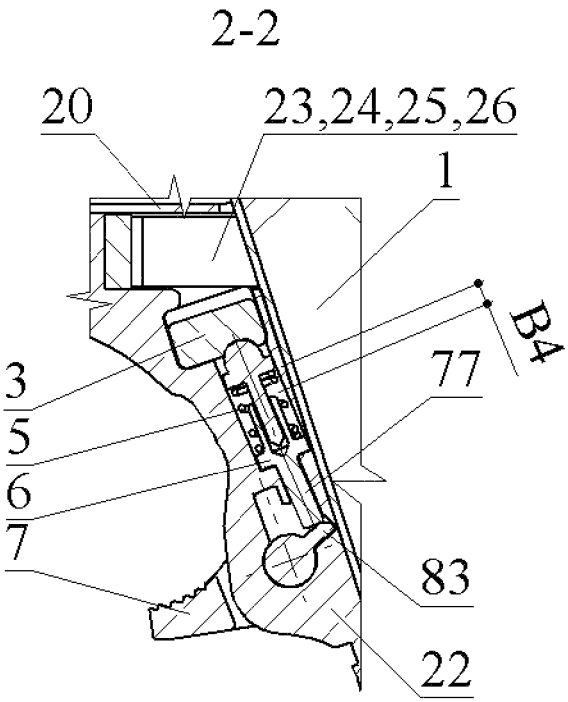
Figure 37:
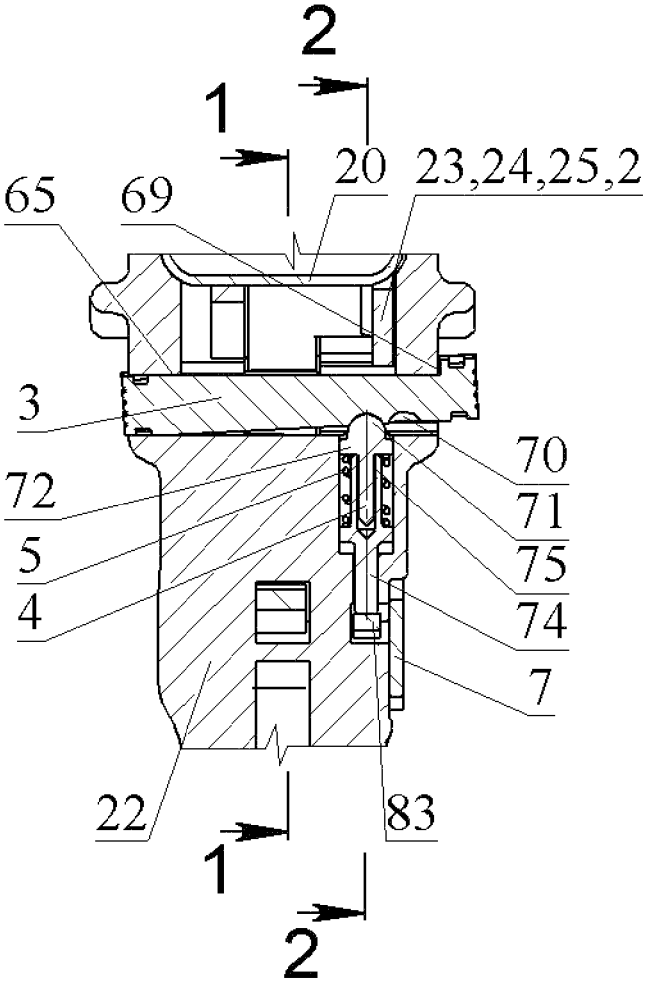
Figure 38:
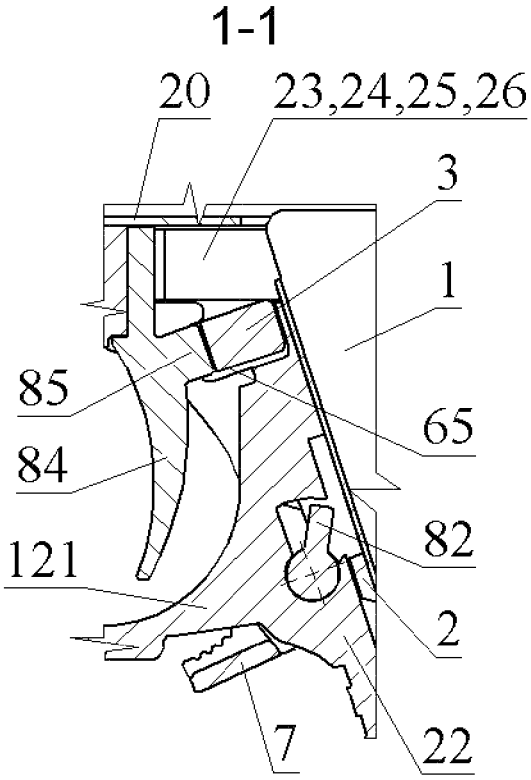
Figure 39:
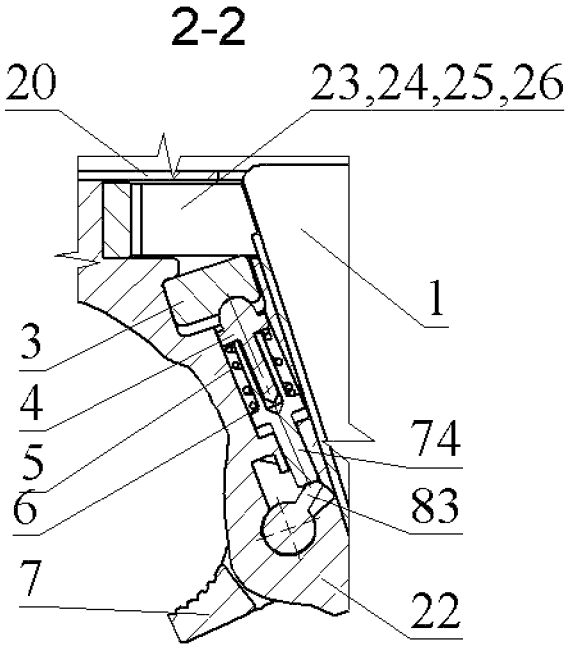
Figure 40:
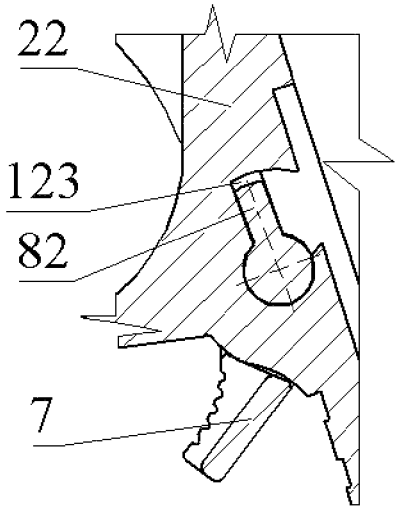
Figure 41:
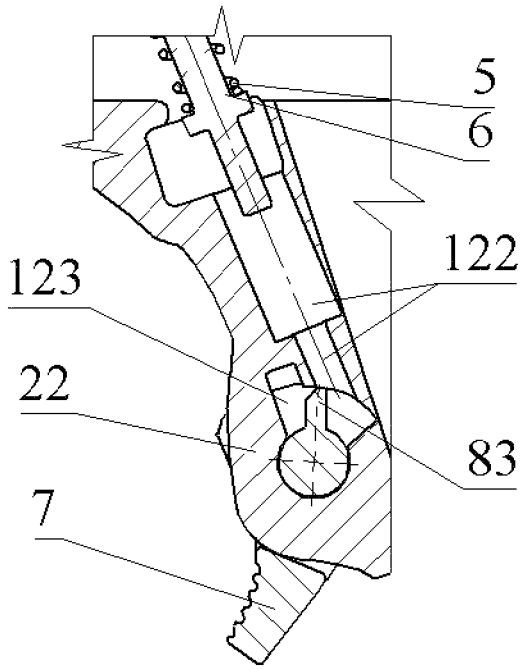
Figure 42:
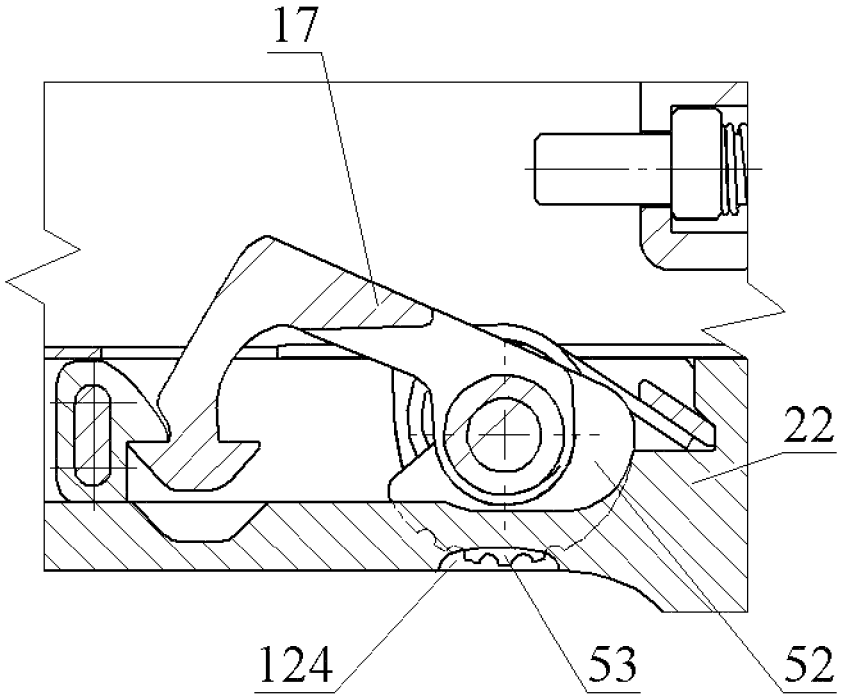
Figure 43:
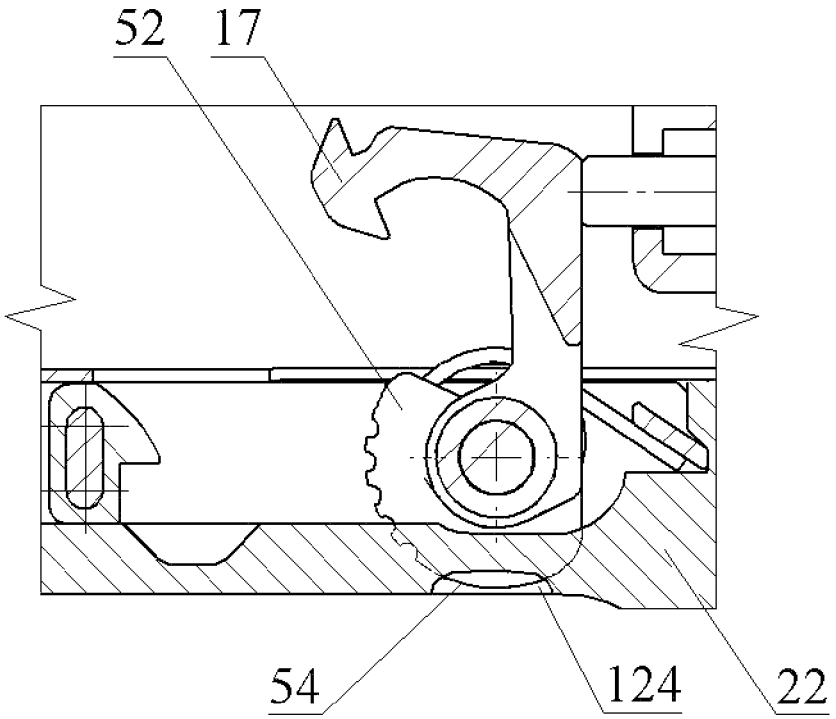
Figure 44:
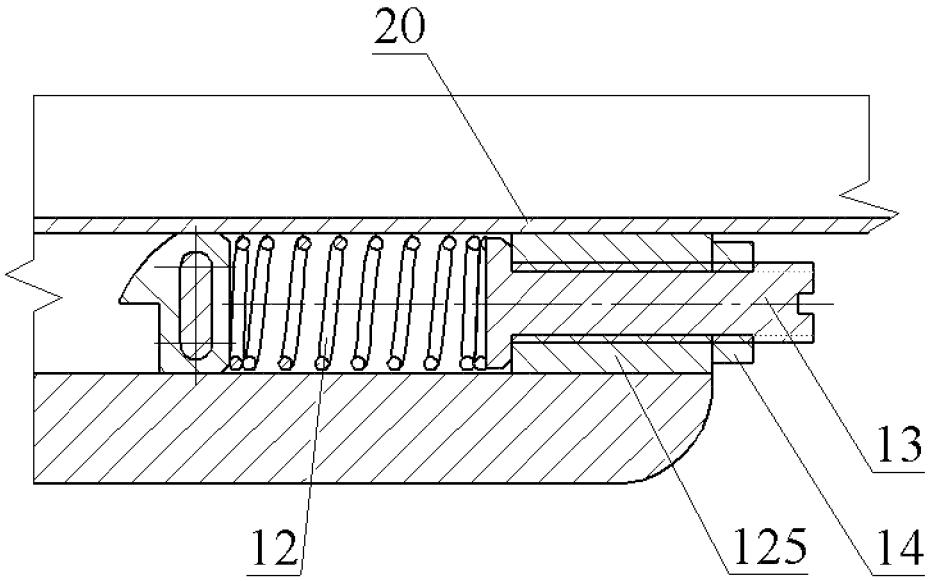
Figure 45:
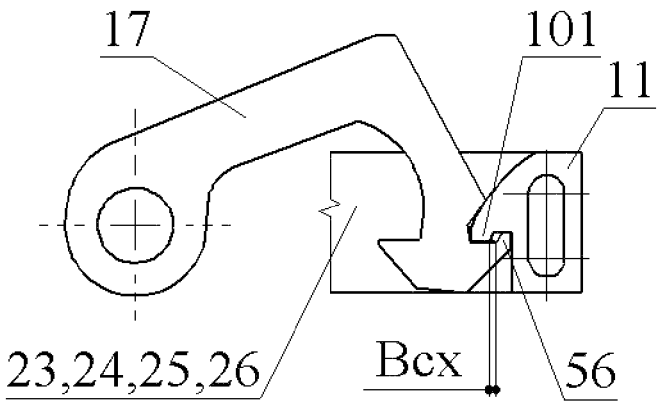
Figure 46:
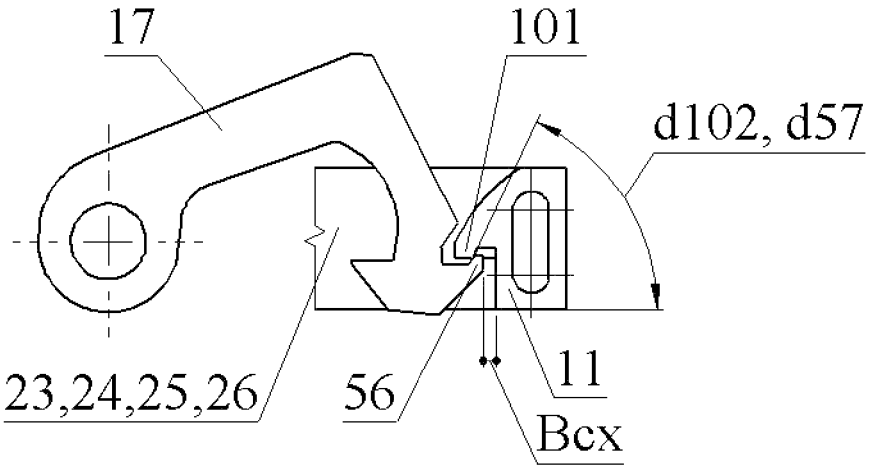
Figure 47:
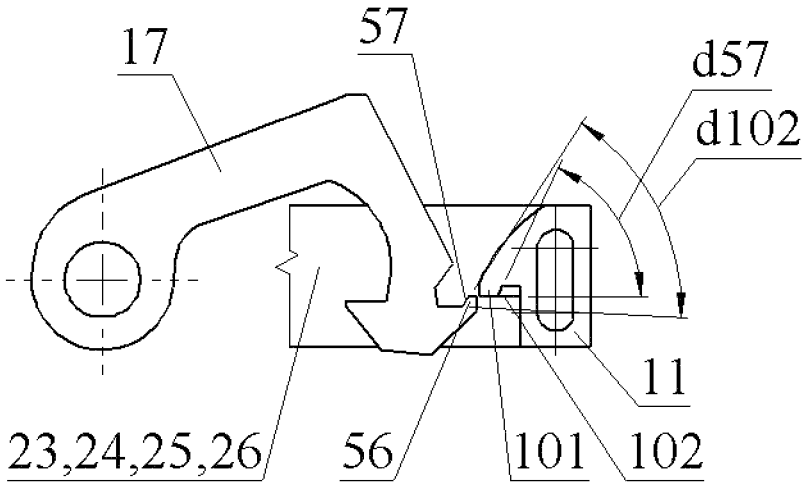
Figure 48:
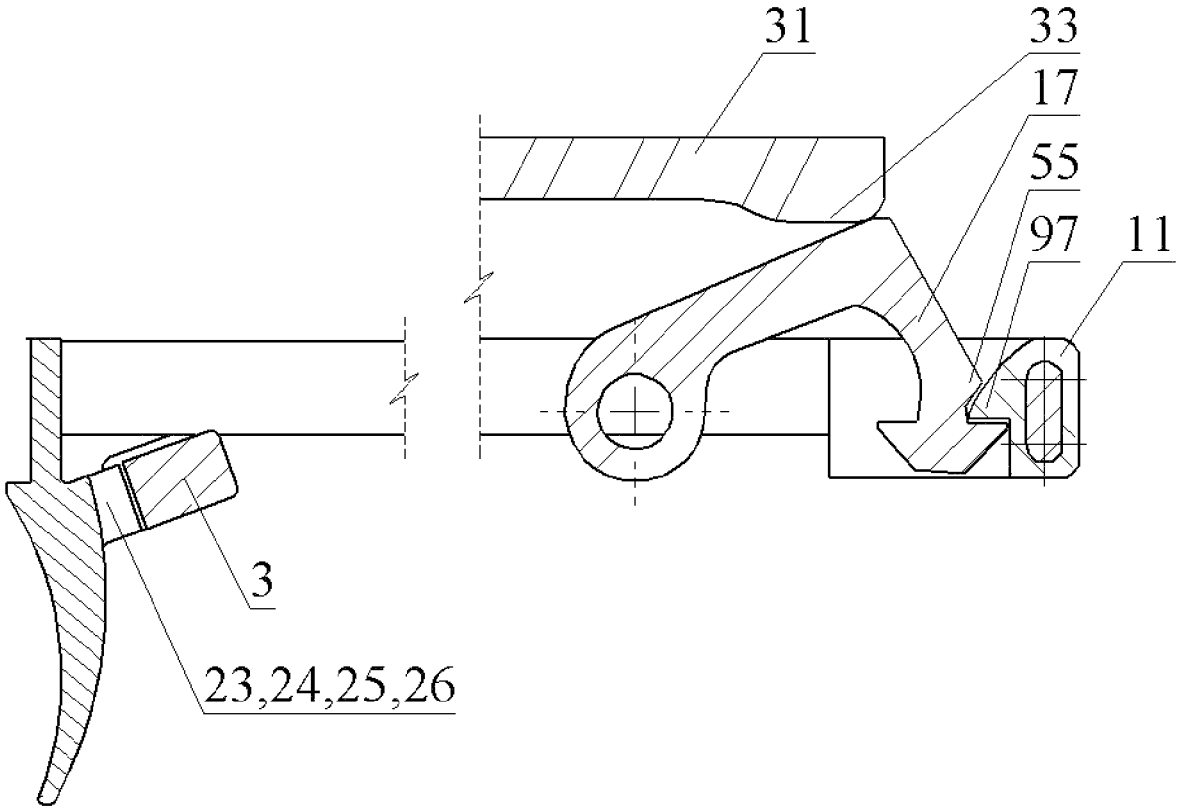
Figure 49:
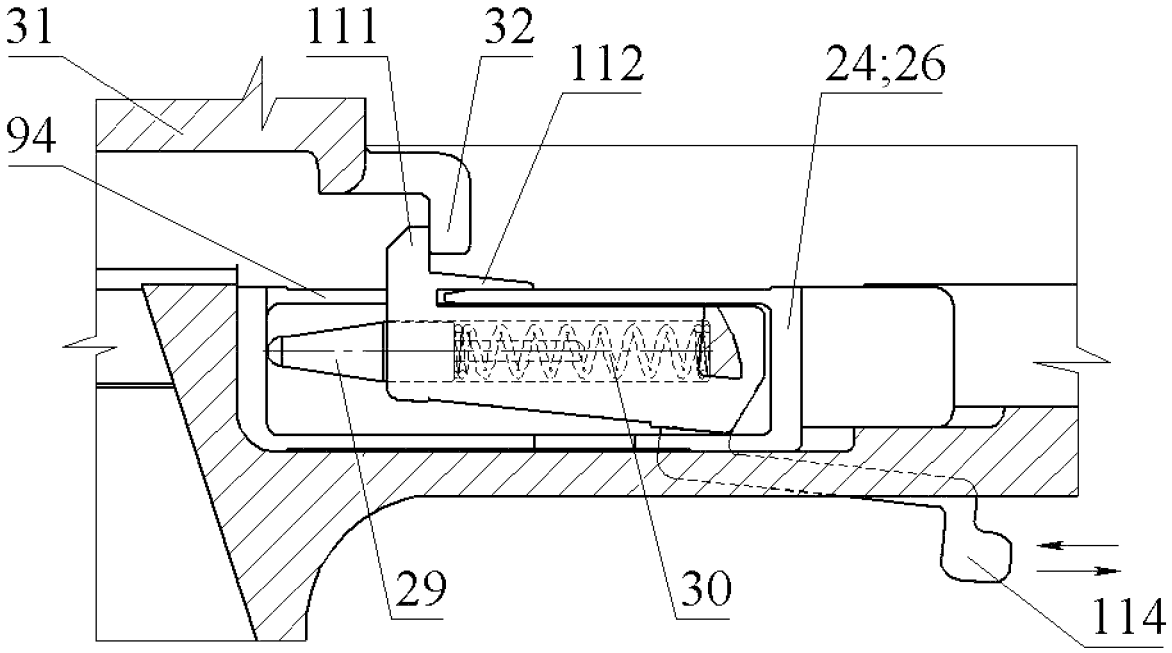
Figure 50:
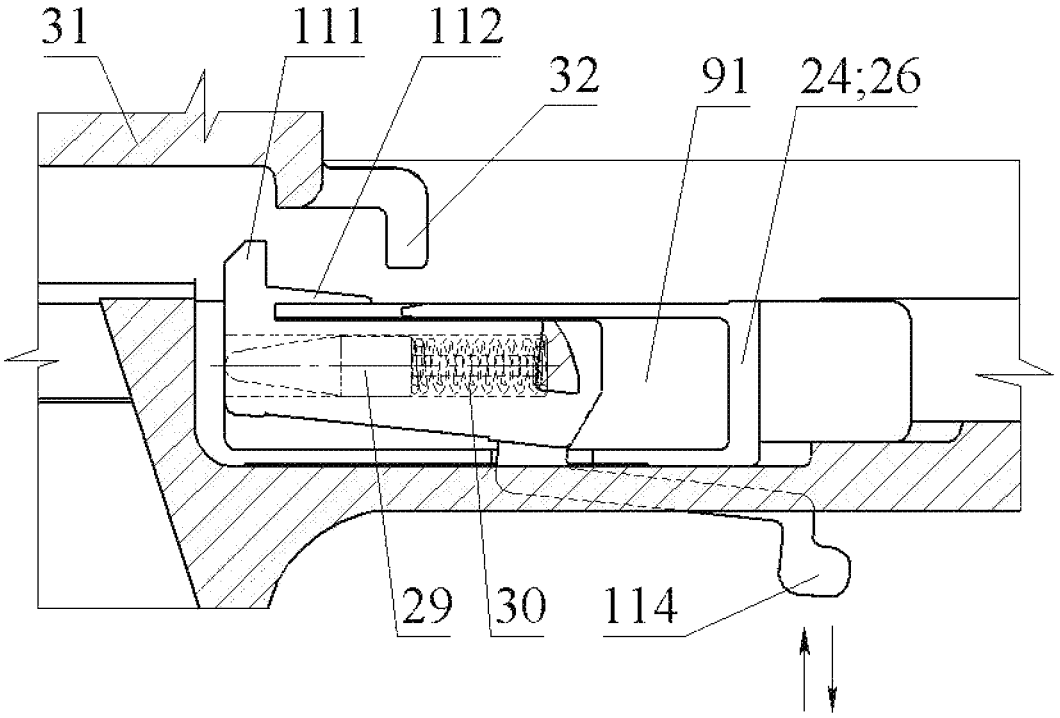
Figure 51:
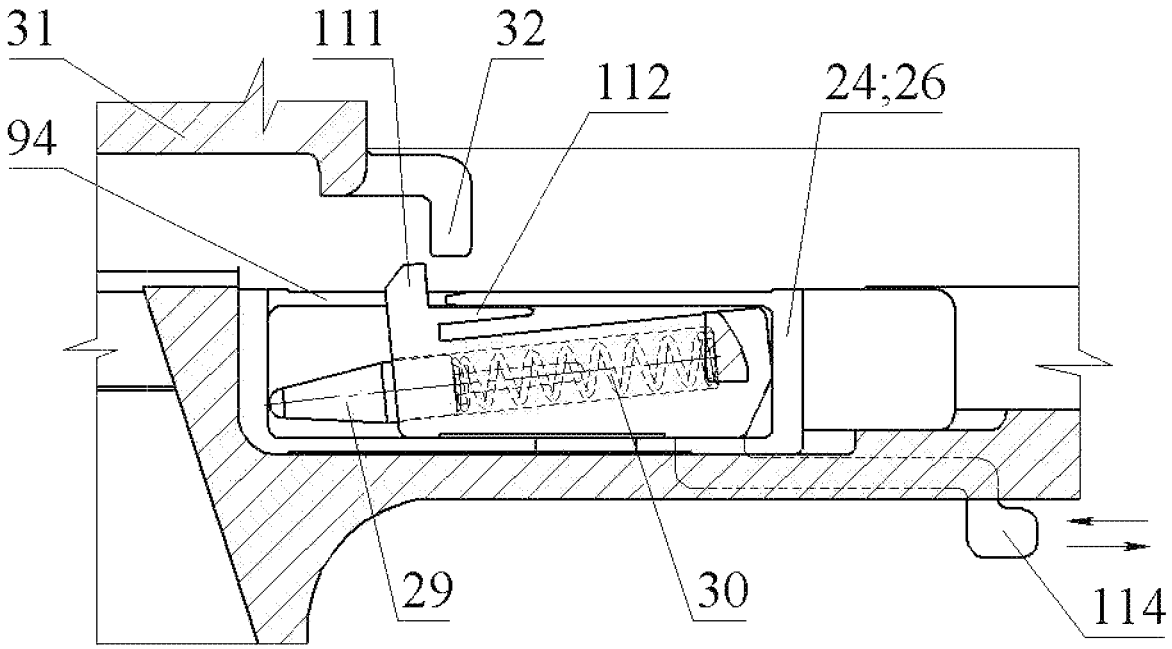
Figure 52:
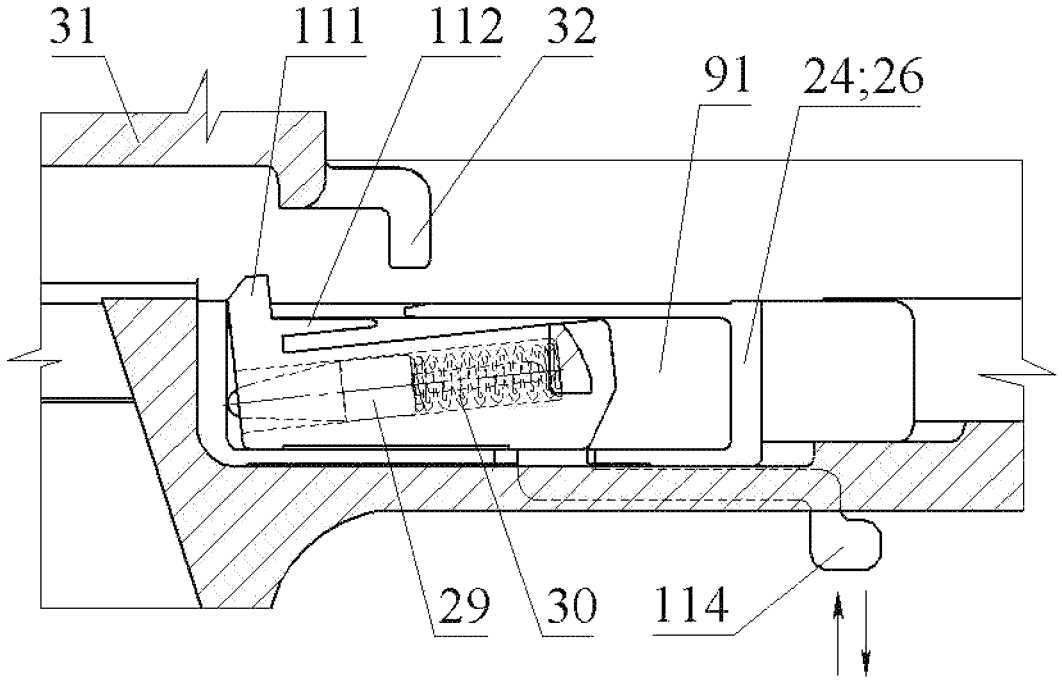
Figure 53:
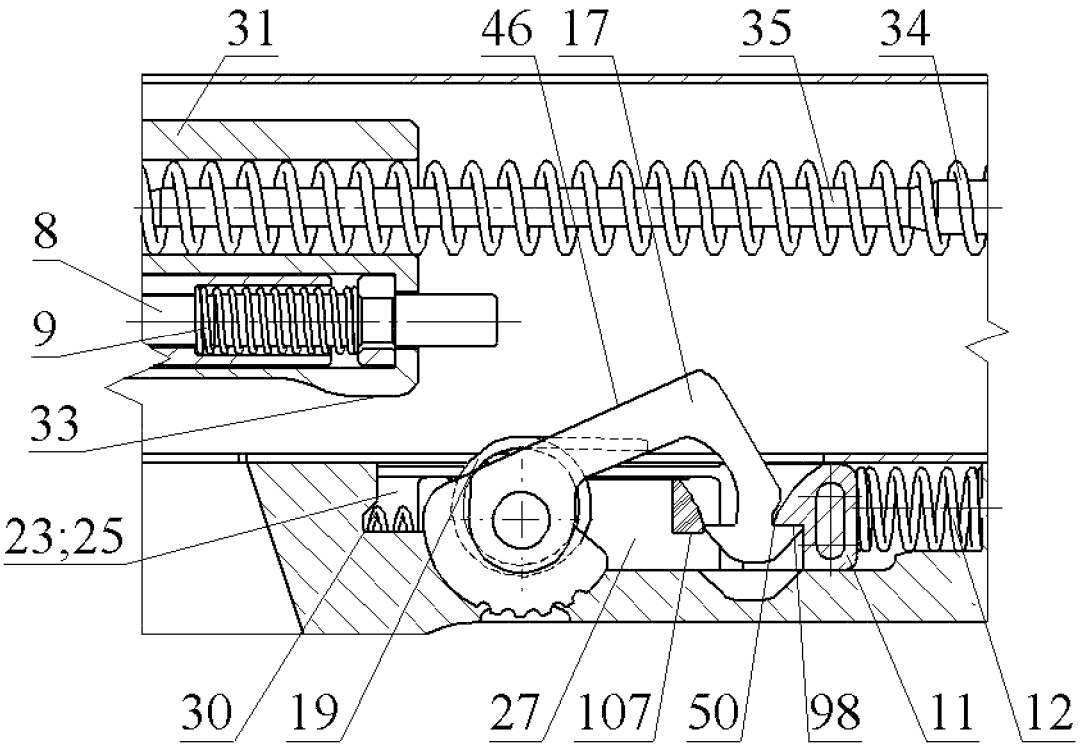
Figure 54:
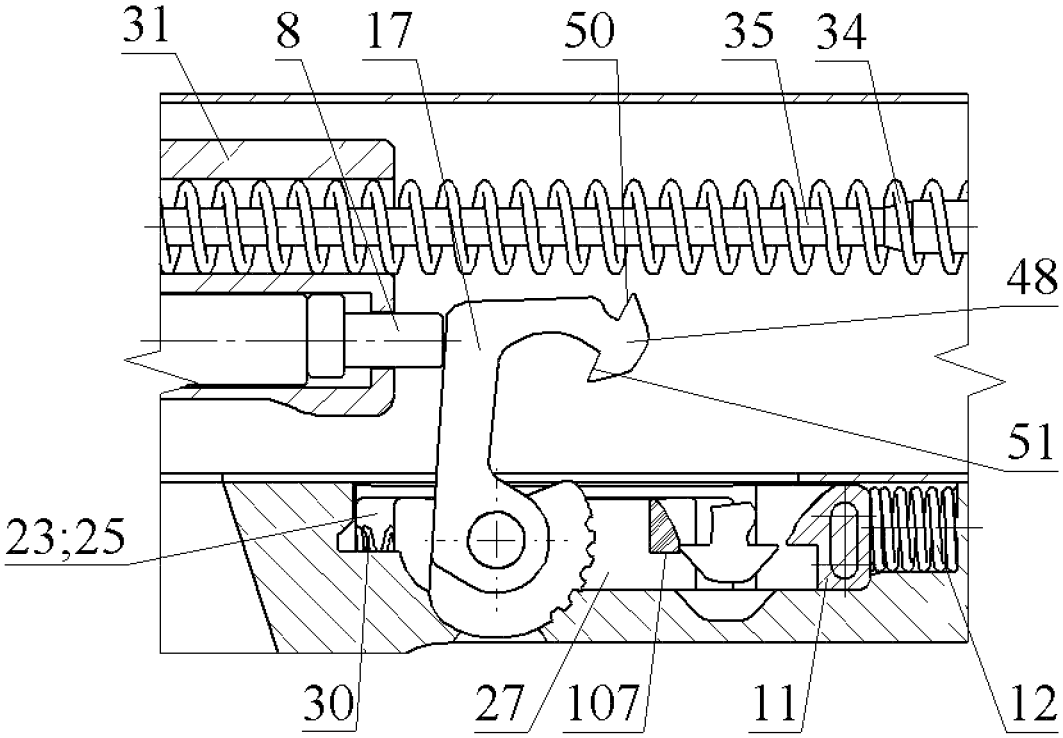
Figure 55:
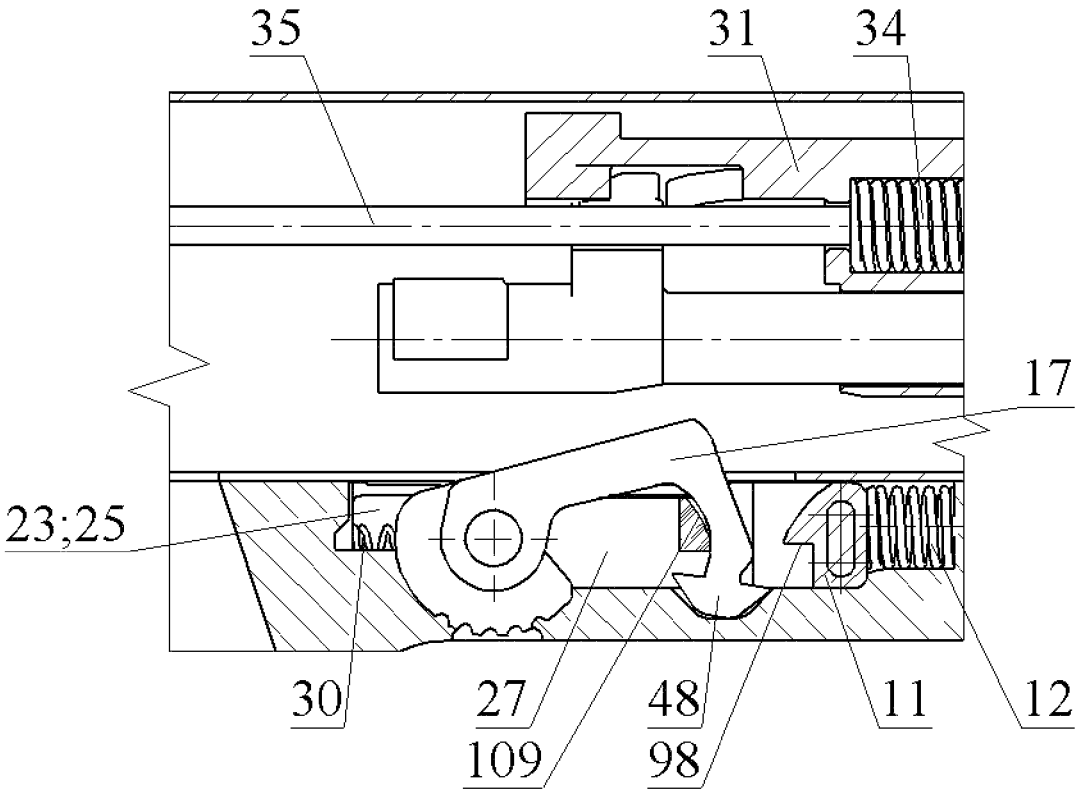
Figure 56:
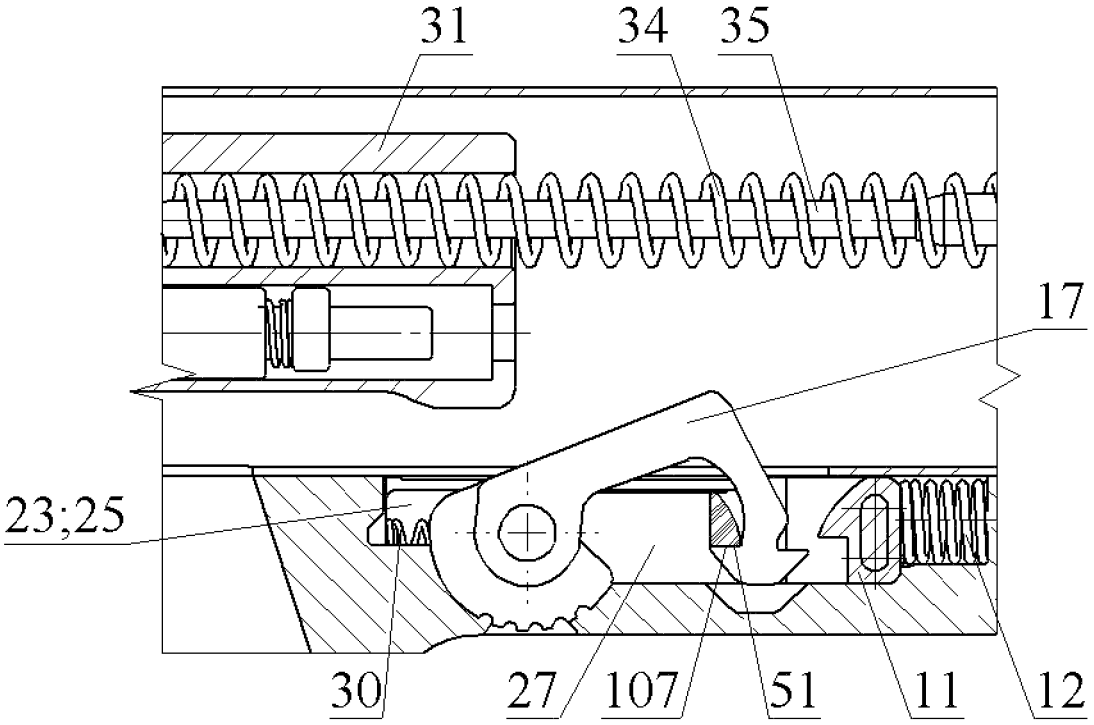
Figure 57:
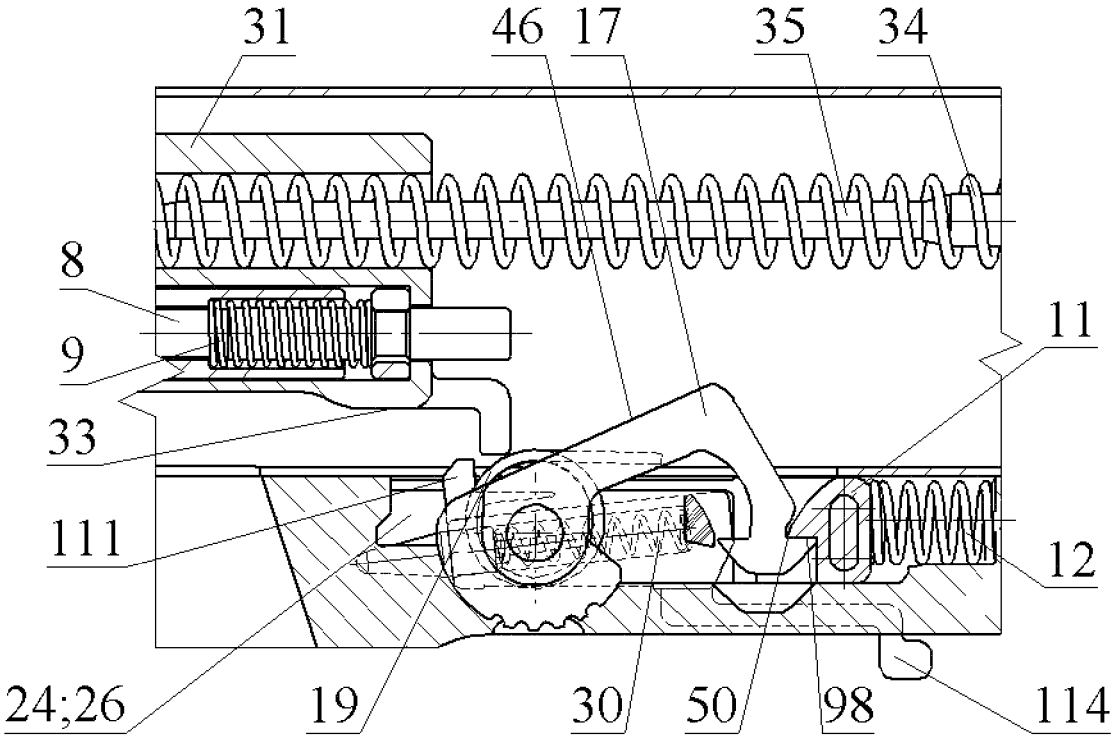
Figure 58:
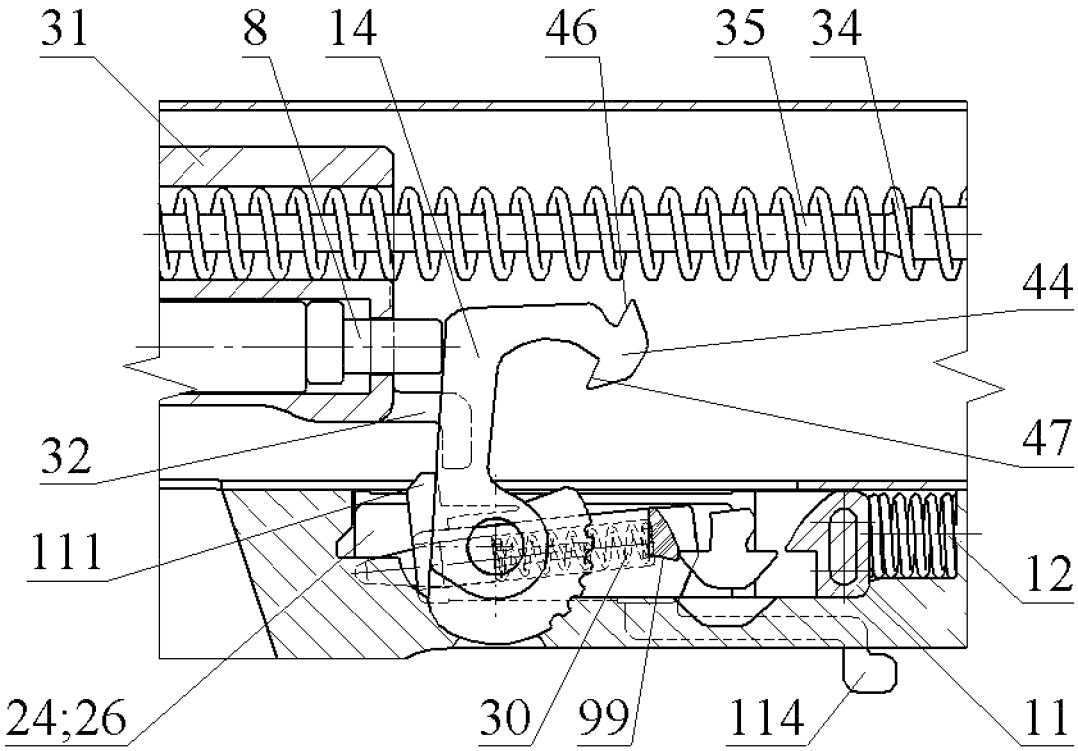
Figure 59:
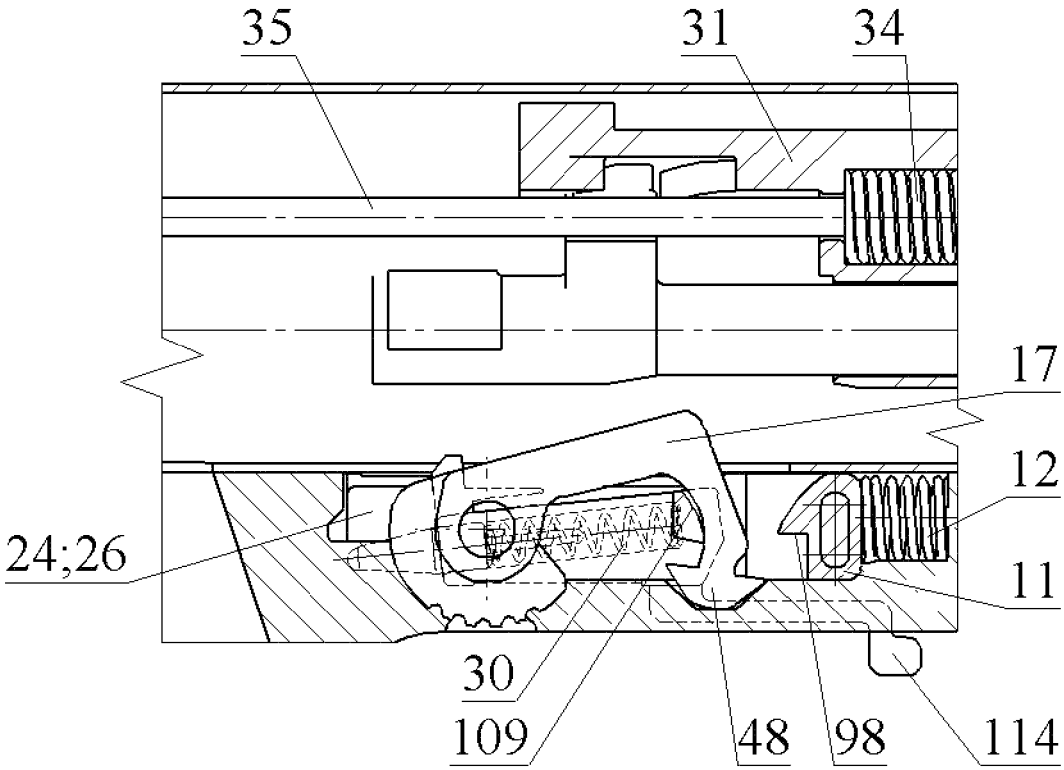
Figure 60:
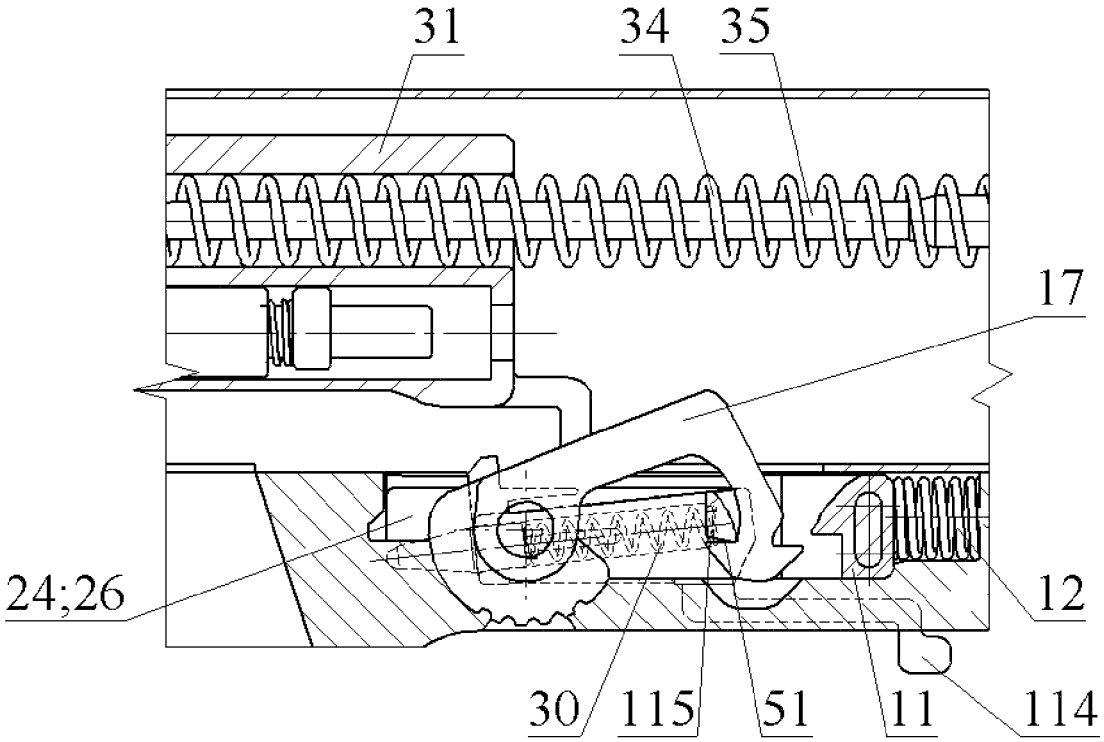
Figure 61:
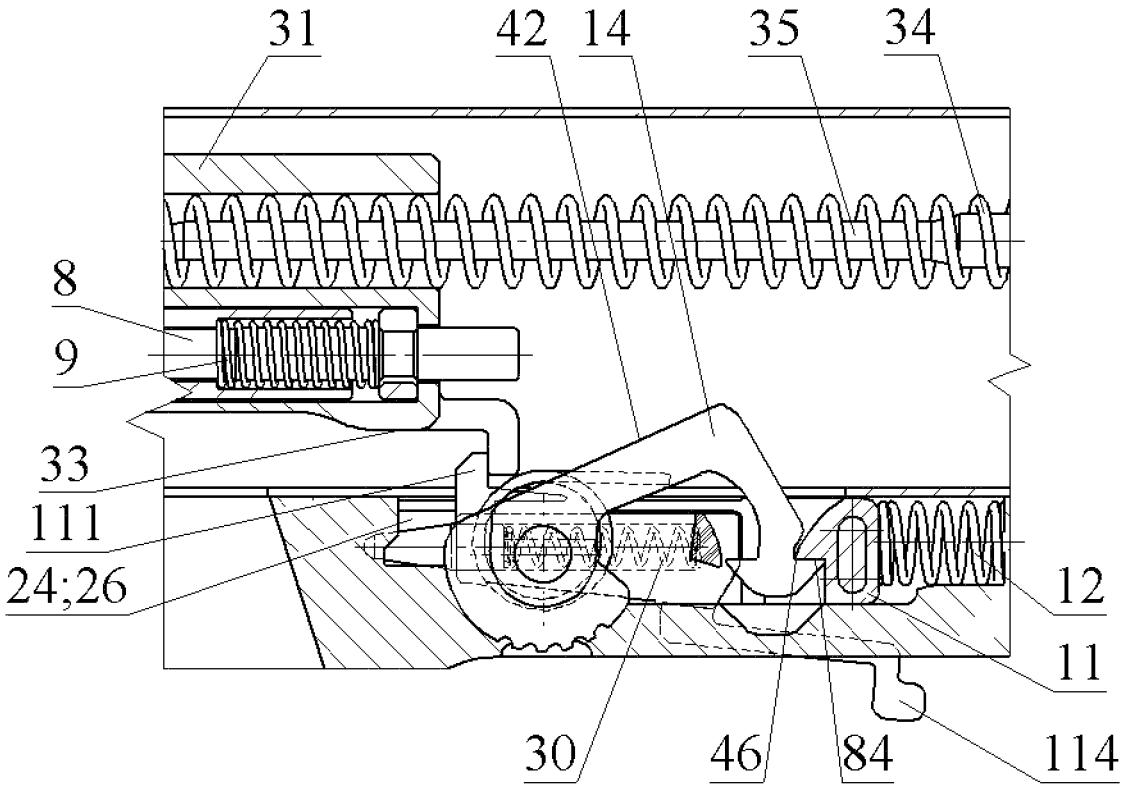
Figure 62:
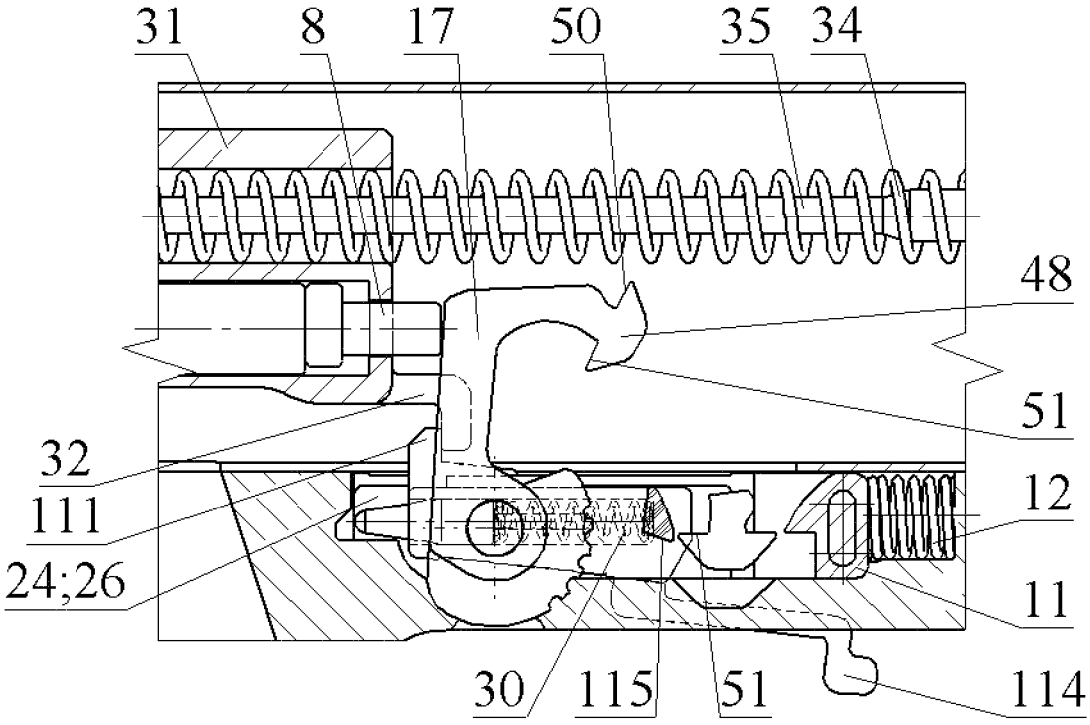
Figure 63:
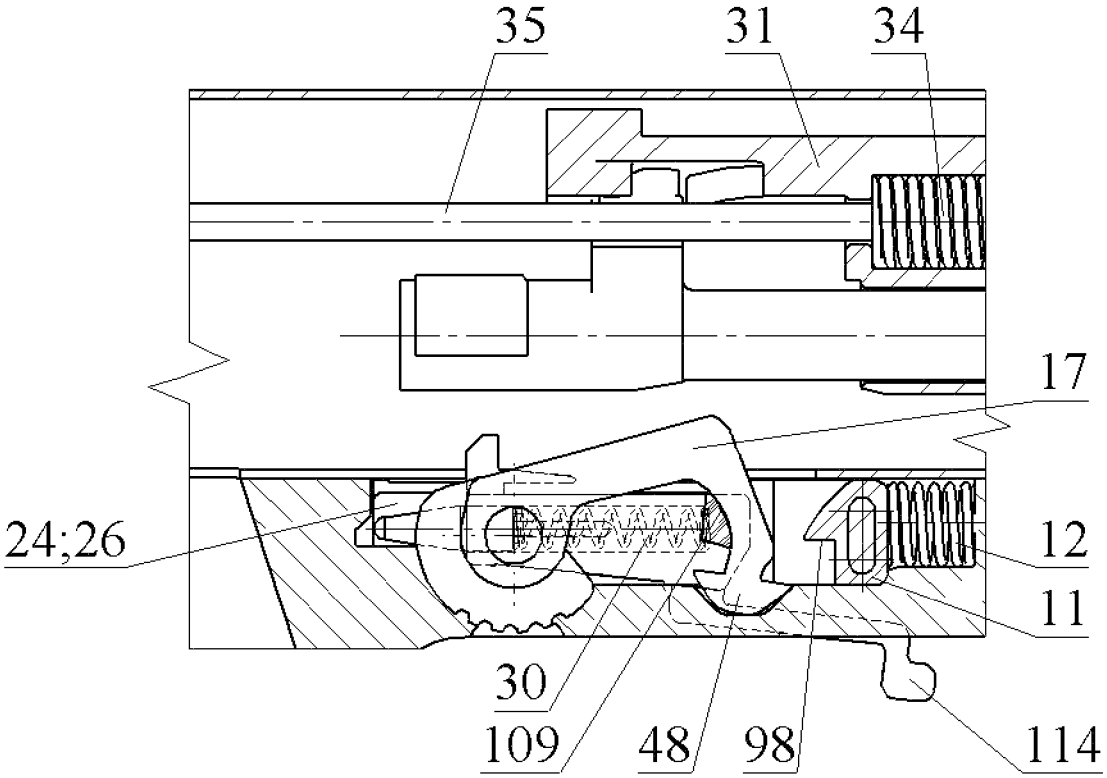

FIG. 17 shows a side view of the pusher 6 of the latch 7 of the magazine 1;

FIG. 18 is a side view of a latch 7 of a magazine 1;

FIG. 19 shows a universal trigger mechanism 36 for semi-automatic fire for a weapon with a magazine in a pistol grip or a weapon made according to the bullpup scheme (side view);

FIG. 19A shows a universal trigger mechanism 41 for semi-automatic fire for weapons with a side pistol grip (side view);

FIG. 20 shows a detail of a universal trigger mechanism 36 for semi-automatic fire for a weapon with a magazine in a pistol grip or a weapon made according to the bull-pup scheme (side view);

FIG. 20A shows a detail of a universal trigger mechanism 41 for semi-automatic fire for weapons with a side pistol grip;

FIG. 21 shows a universal trigger mechanism 37 for semi-automatic and automatic fire for weapons with a magazine in a pistol grip or weapons, made according to the bull-pup scheme (side view);

FIG. 21A shows a universal trigger mechanism 42 for semi-automatic and automatic fire for weapons with a side pistol grip (side view);

FIG. 22 shows a detail of a universal trigger mechanism 37 for semi-automatic and automatic fire for weapons with a magazine in a pistol grip or weapons made according to the bull-pup scheme (side view);

FIG. 22A shows a detail of a universal trigger mechanism 42 for semi-automatic and automatic fire for weapons with a side pistol grip (side view);

FIG. 23 shows the trigger bar 23 (side view);

FIG. 24 shows the trigger bar 24 (side view);

FIG. 25 shows the trigger bar 25 (side view);

FIG. 26 shows the trigger bar 26 (side view);

FIG. 27 shows the sear 11 (side view);

FIG. 28 shows a bottom view of the sear 11 for trigger mechanisms with alarm;

FIG. 29 shows a side view of the single-shot sear 27;

FIG. 30 shows a cross-section A-A in section 104 of the single-shot sear 27;

FIG. 31 shows a side view of the multifunctional switch 28;

FIG. 32 shows a cross-section through the sear section 113 for multifunctional switch 28;

FIG. 33 shows a side view of the axis 29 of the multifunctional switch 28;

FIG. 34, FIG. 35 (section 1-1 in FIG. 34), FIG. 36 (section 2-2 in FIG. 34) shows the operation of the latch 7 of the magazine 1 in a fixed position and the operation of the safety catch 3 in the on position "fire";

FIG. 37, FIG. 38 (section 1-1 in FIG. 37), FIG. 39 (section 2-2 in FIG. 37) shows the operation of the latch 7 of the magazine 1 when pressed and the operation of the safety catch 3 in the off position "safety";

FIG. 40, FIG. 41 show the disassembly and assembly of the latch 7 of the magazine 1;

FIG. 42, FIG. 43 show an indication of the state of cocking piece 17;

FIG. 44 shows a fragment of a longitudinal section of the mechanism by the adjusting screw 13. Adjusting the compression force of the spring 12 of the trigger bar (side view);

FIG. 45, FIG. 46 and FIG. 47 show the operation of the cocking piece 17 and sear 11 in safety mode (side view);

FIG. 48 shows the operation of the safety catch 3 in the safety position against arbitrary cocking (side view);

FIG. 49, FIG. 50, FIG. 51, FIG. 52 show the operation of the multifunctional switch 28;

FIG. 53, FIG. 54, FIG. 55, FIG. 56 show the operation of the universal trigger mechanism in the "semi-automatic fire" mode;

FIG. 57, FIG. 58, FIG. 59, FIG. 60 show the operation of the universal trigger mechanism for semi-automatic and automatic fire in the "semi-automatic fire" mode;

FIG. 61, FIG. 62, FIG. 63, FIG. 64 show the operation of the universal trigger mechanism for semi-automatic and automatic fire in the "automatic fire" mode.

DESIGNATIONS USED IN THE CLAIMED INVENTION

1—magazine;
2—locking protrusion;
3—safety catch;
4—safety latch;
5—spring of a pusher;
6—pusher;
7—latch;
8—firing pin;
9—spring of the firing pin;
10—firing pin locker;
11—sear;
12—spring of the trigger bar;
13—adjusting screw;
14—lock nut;
15—shutter housing;
16—bracket;
17—cocking piece;
18—axis of the cocking piece;
19—mainsprings;
20—receiver;
21—cover;
22—trigger housing for weapons with a magazine in a pistol grip;
23—trigger bar;
24—trigger bar;
25—trigger bar;
26—trigger bar;
27—the single-shot sear;
28—multifunctional switch;
29—axis of the multifunctional switch;
30—trigger mechanism spring;
31—lock frame;
32—hook-shaped protrusion;
33—bulge at the rear end;
34—returnable spring;
35—guide rod of a returnable spring;
36—universal trigger mechanism for semi-automatic fire for weapons
with a magazine in the pistol grip or weapons, made according to the bull-pup scheme;
37—universal trigger mechanism for semi-automatic and automatic fire
for weapons with a magazine in a pistol grip or weapons made according to the bull-pup scheme;
38—universal percussion mechanism;
39—trigger housing for weapons according to the bull-pup scheme;
40—trigger housing for weapons with a side pistol grip;
41—universal trigger mechanism for semi-automatic fire for weapons with a side pistol grip;
42—universal trigger mechanism for semi-automatic and automatic fire for weapons with side pistol grip;
43—cylindrical protrusion;
44—through hole;
45—base of the cocking piece;
46—cocking piece percussion platform;
47—cocking piece tail;
48—cocking piece tip;
49—damper platform;
50—cocking position platform;
51—protrusion with the platform;
52—cocking indicator;
53—notched section;
54—smooth section;
55—protrusion;
56—protrusion;
57—inclined platform;
58—plates;
59—transverse plate;
60—hole;
61—hole;
62—cylinder;
63—slot;
64—rectangular rod;
65—large slot;
66—small slot;
67—slot of a triangular shape;
68—protrusion;
69—slots;
70—spherical recesses;
71—spherical head;
72—cylindrical section;
73—axis;
74—cone;
75—cylindrical portion;
76—washer;
77—axis;
78—washer;
79—lever;
80—slot;
81—rod;
82—locking protrusion;
83—protrusion;
84—trigger;
85—safety protrusion;
86—front protrusion;
87—base of the trigger for the trigger bar 23 or trigger bar 24;
88—base of the cocking piece for the trigger bar 25 or trigger bar 26;
89—thrust;
90—bar;
91—rectangular cavity;
92—protrusion;
93—rear protrusion;
94—hole;
95—figured slot;
96—bar;
97—protrusion;
98—support platform of the sear;
99—through hole;
100—locking protrusion;
101—T-shaped protrusion;
102—inclined platform;
103—rod;
104—sear section;
105—rack of the sear;
106—blind hole;
107—lower horizontal surface;
108—front vertical surface;
109—rear radius surface;
110—trapezoidal bar;
111—rack;
112—horizontal protrusion;
113—sear section;
114—protrusion;
115—lower inclined surface;
116—conical section;
117—spherical head;
118—cylindrical portion;
119—cylindrical portion;

120—chamfer;
121—trigger bracket;
122—blind hole;
123—through hole;
124—slot;
125—threaded stop.

Figure 1:
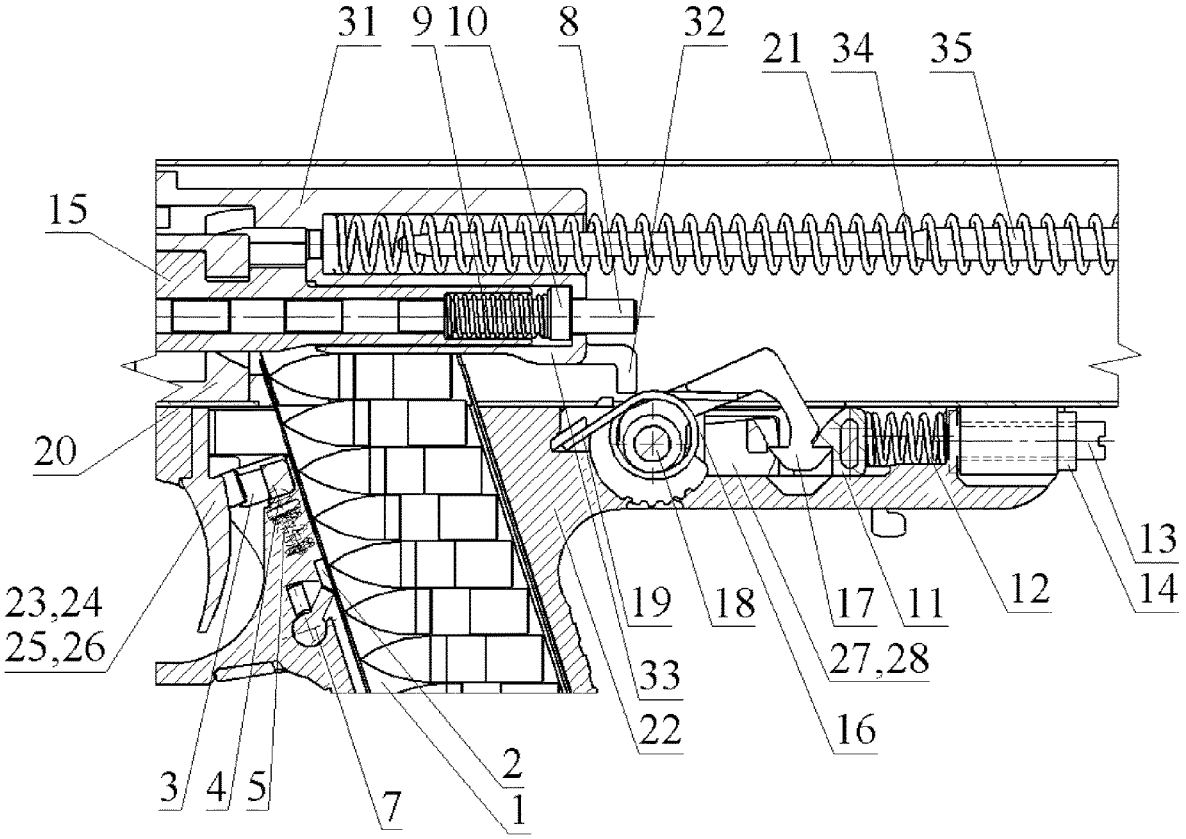
FIG. 1 shows a longitudinal section of the proposed mechanism.
Figure 2:
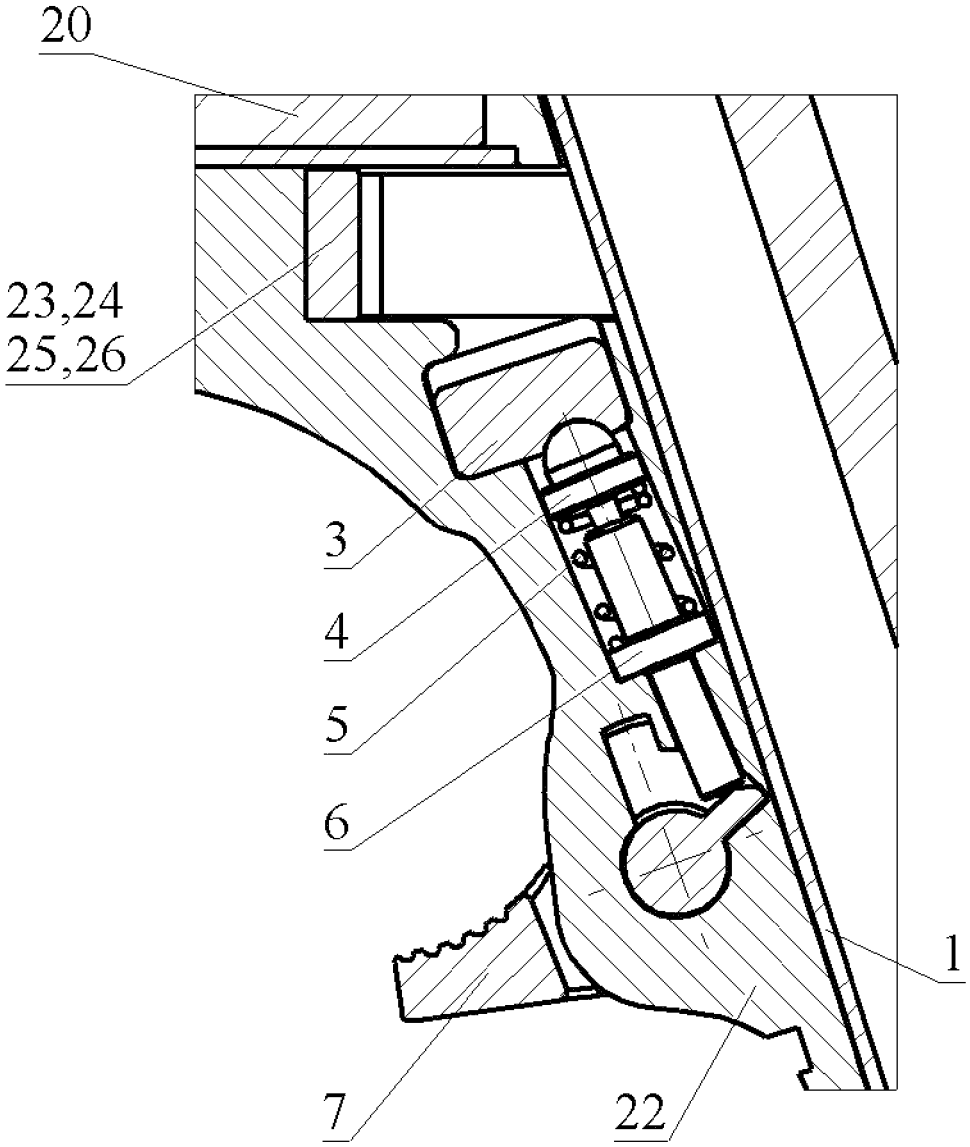
FIG. 2 shows a fragment of a longitudinal section of the mechanism on the pusher 6 of the magazine latch 1.
Figure 3:
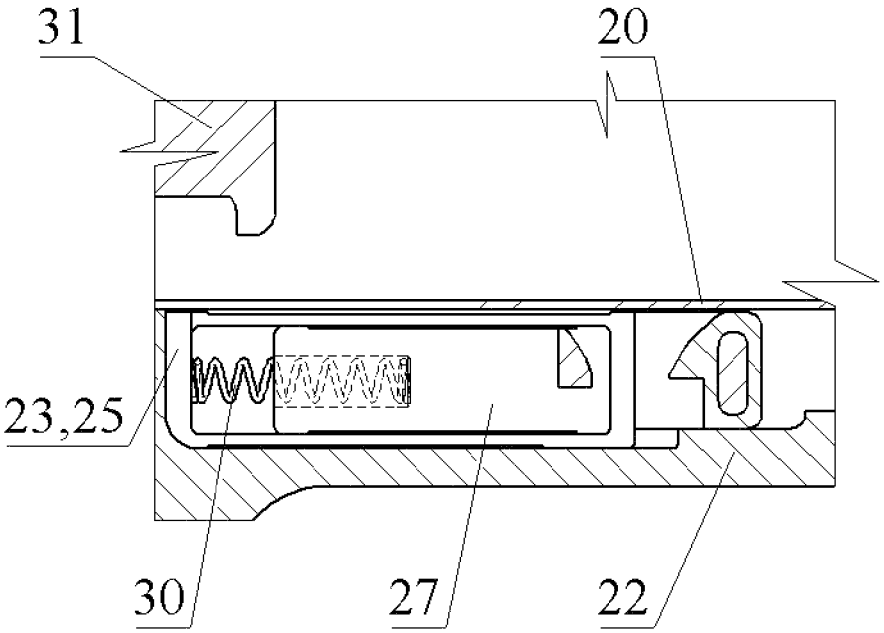
FIG. 3 shows a fragment of a longitudinal section of the mechanism on the single-shot sear 27.
Figure 4:
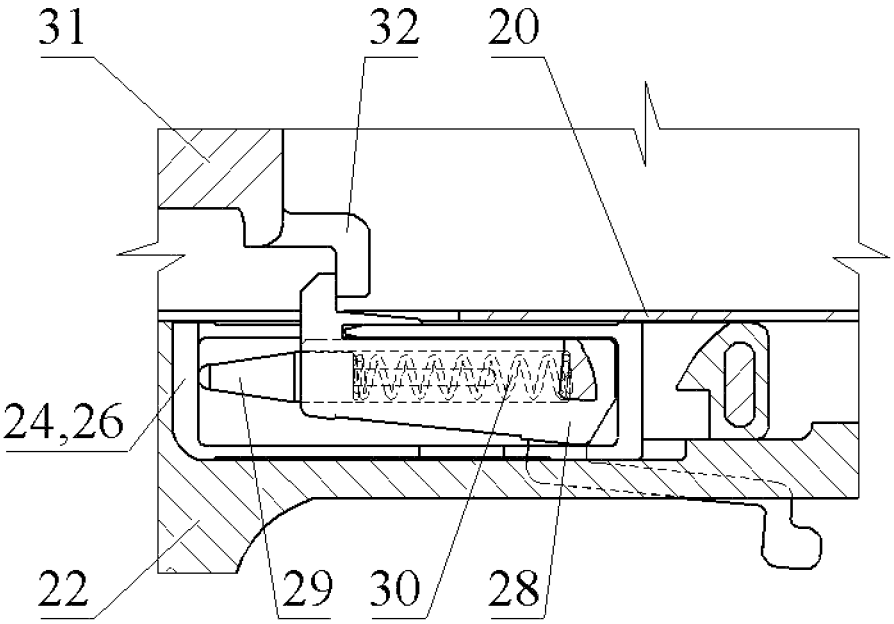
FIG. 4 shows a fragment of a longitudinal section of the mechanism on the multifunctional switch 28.
Figure 64:
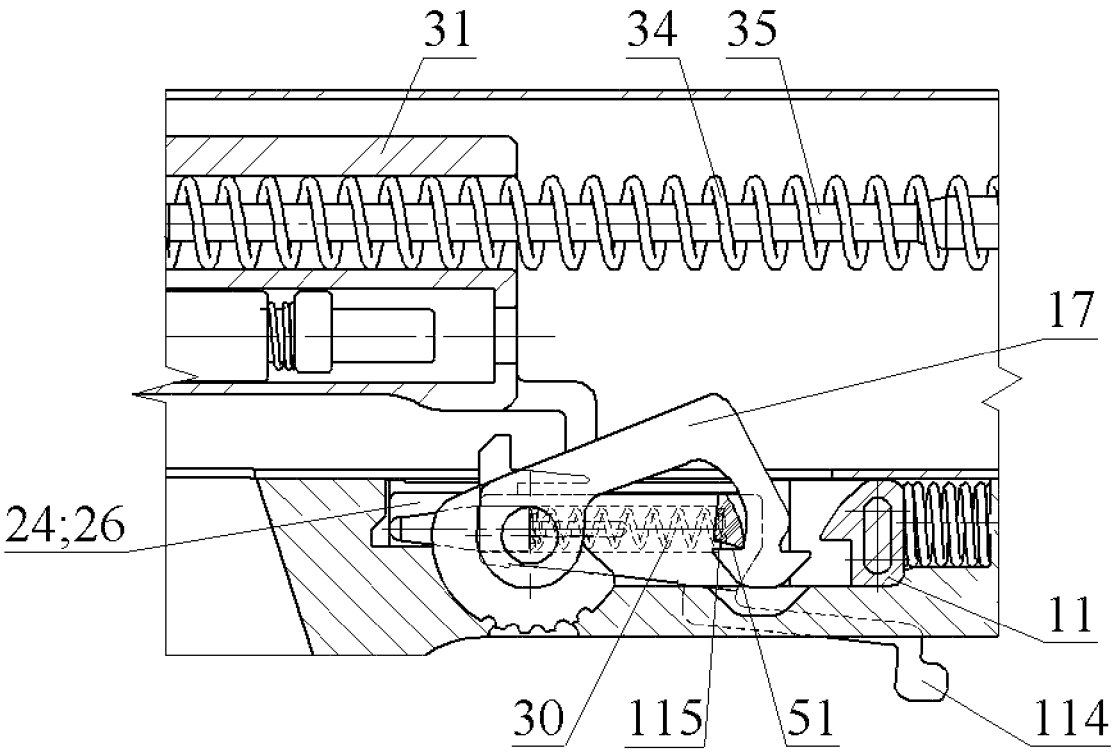

The device and operation of the proposed percussion trigger mechanism, which is claimed as the invention, is set forth considering the introduced positioned components and fragments shown in the drawings of FIGS. 1-64, as well as the above-mentioned sets of main and additional essential features.

The following is a detailed description of the drawings of the individual nodes and elements of the proposed invention.

As shown in FIGS. 1 to 4, the universal percussion trigger mechanism, which consists of: magazine 1 with a locking protrusion 2, safety catch 3, latch 4 of the safety catch 3, spring of a pusher 5 of safety catch 3, pusher 6 of a magazine latch, magazine latch 7, firing pin 8, firing pin spring 9, firing pin locker 10, sear 11, spring 12 of the trigger bar, adjusting screw 13, lock nut 14 of adjusting screw, shutter housing 15, bracket 16 for universal percussion mechanism, cocking piece 17, cocking piece axis 18, mainsprings 19, receiver 20, cover 21, trigger housing 22, trigger bar 23 or 24 or 25 or 26, single-shot sear 27, multifunctional switch 28, axis 29 of the multifunctional switch, spring 30 of the trigger mechanism, lock frame 31 with hook-shaped protrusion 32 and a bulge at the rear end 33, the returnable spring 34, the guide rod 35 of the returnable spring 34.

Figure 5:
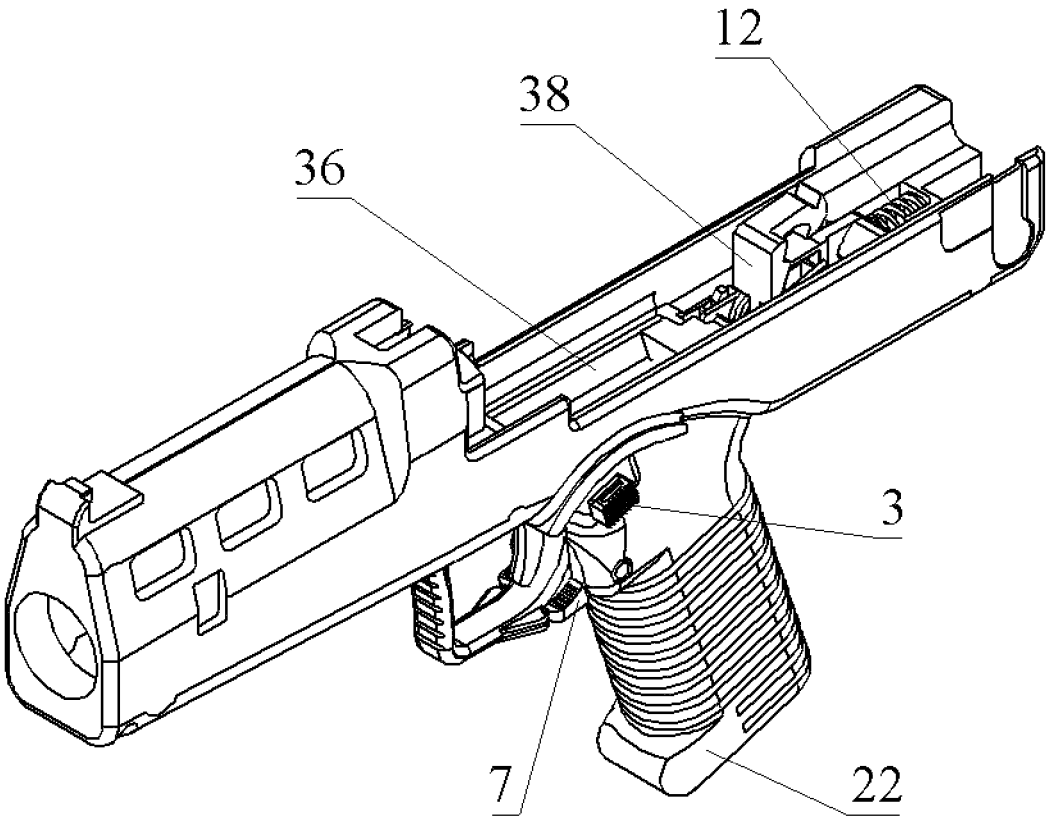
FIG. 5 and FIG. 5A show the use of the proposed mechanism for weapons with a magazine in a pistol grip (side view)

FIG. 5 shows the use of a universal trigger mechanism for weapons with a magazine in a pistol grip. This configuration consists of: safety catch 3, spring 12 of the trigger bar, trigger housing 22, universal trigger mechanism 36 for semi-automatic fire, and universal percussion mechanism 38.

Figure 5A:
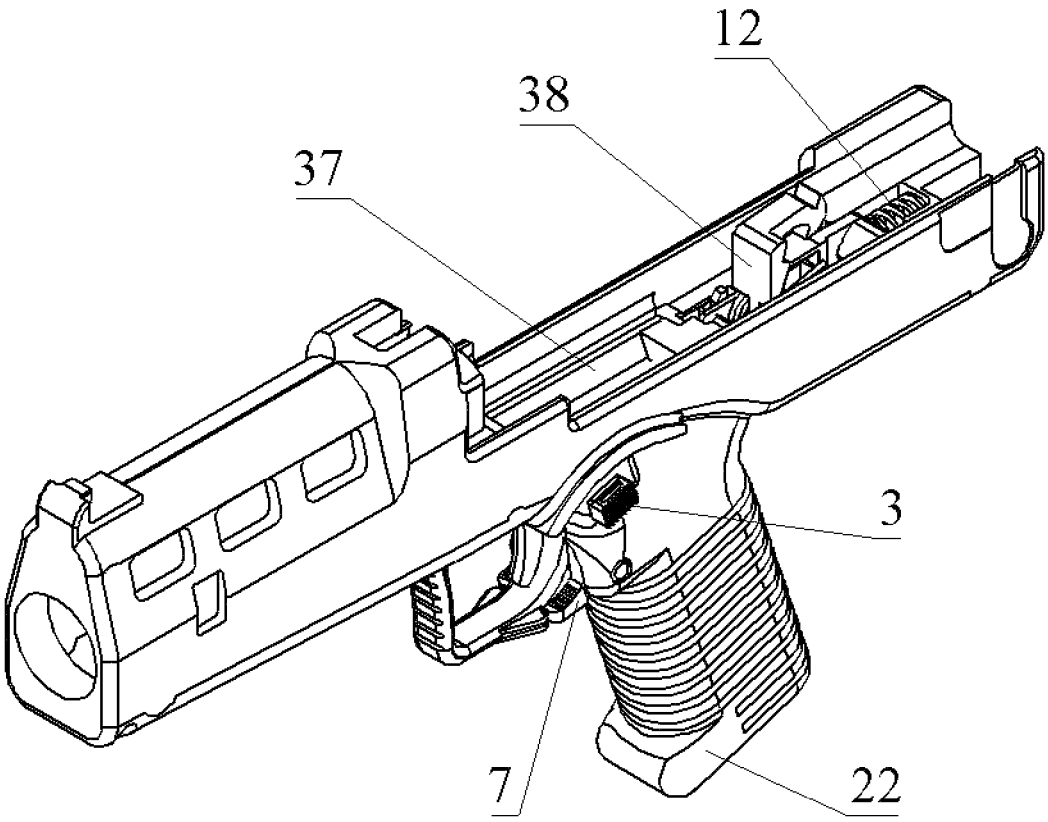

FIG. 5A shows the use of a universal trigger mechanism for weapons with a magazine in a pistol grip. This configuration consists of: safety catch 3, spring 12 of the trigger bar, trigger housing 22, universal trigger mechanism 37 for semi-automatic and automatic fire, and universal percussion mechanism 38.

Figure 6:
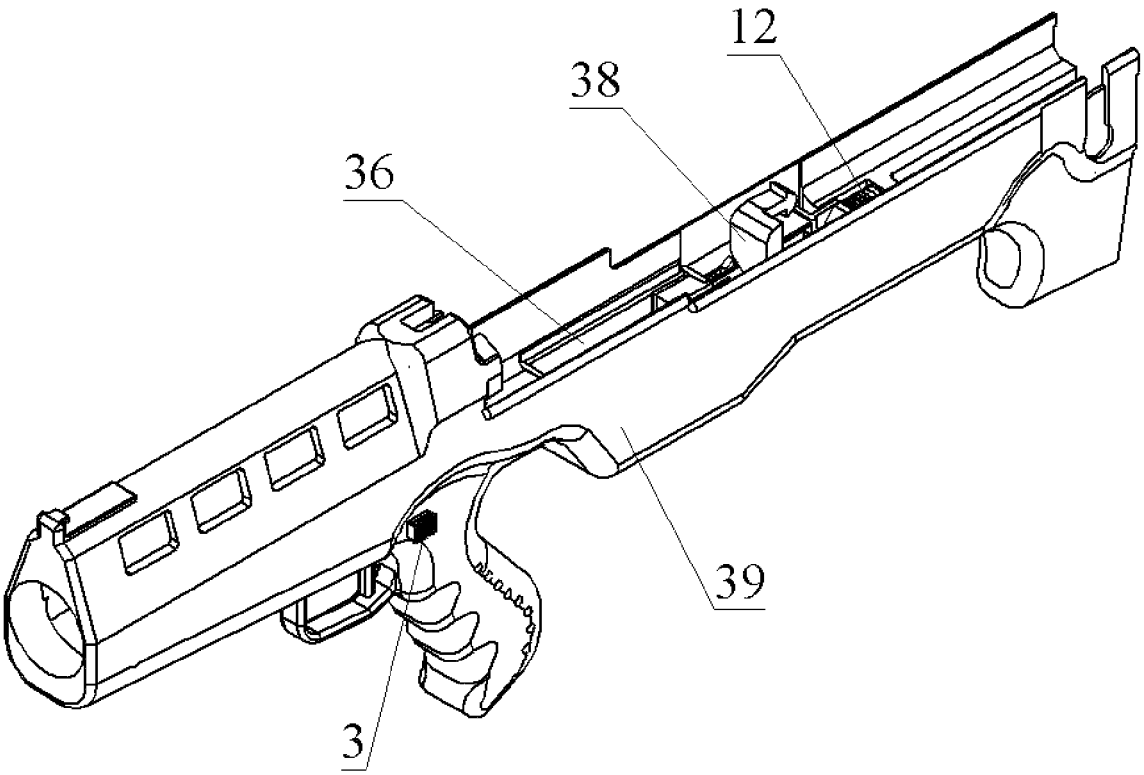
FIG. 6 and FIG. 6A show the use of the proposed mechanism for weapons, made according to the bull-pup scheme (side view)

FIG. 6 shows the use of a universal trigger mechanism for weapons, made according to the bull-pup scheme. This configuration consists of: safety catch 3, spring 12 of the trigger bar, universal trigger mechanism for semi-automatic fire 36, universal percussion mechanism 38, and trigger housing 39.

Figure 6A:
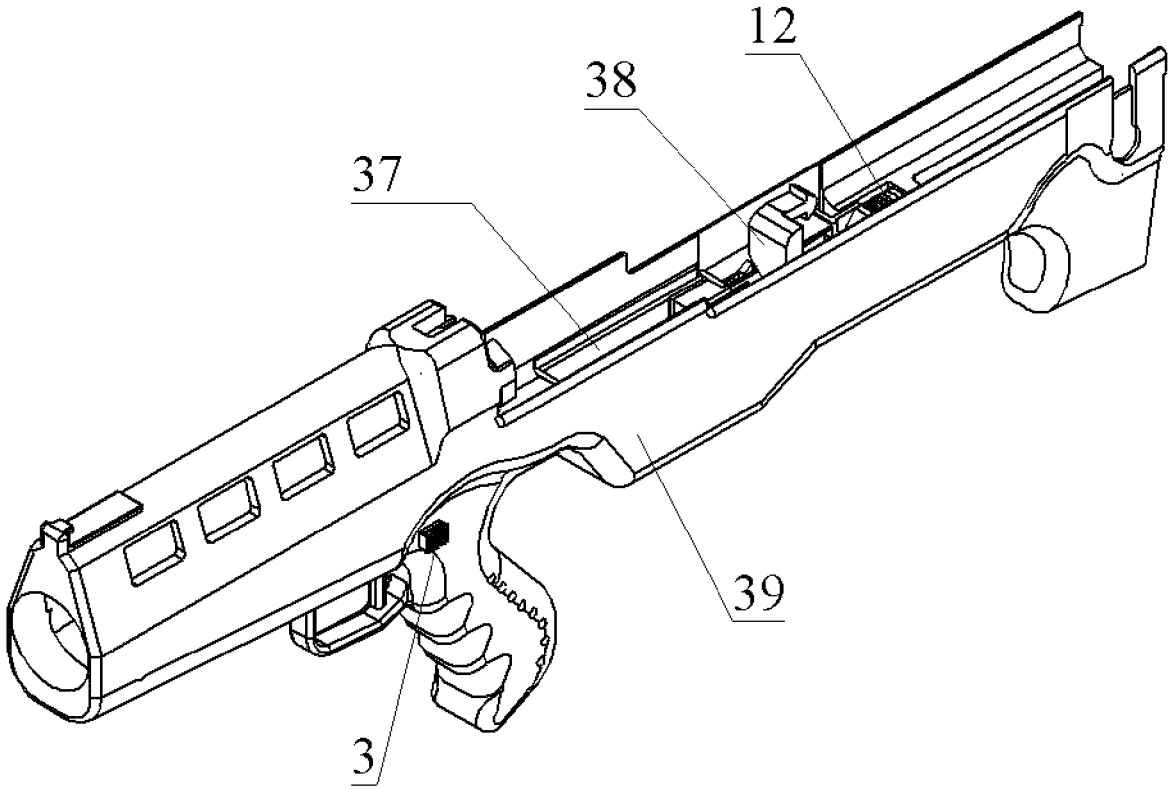

FIG. 6A shows the use of a universal trigger mechanism for weapons, made according to the bull-pup scheme. This configuration consists of: safety catch 3, spring 12 of the trigger bar, universal trigger mechanism 37, universal percussion mechanism 38, and trigger housing 39.

Figure 7:
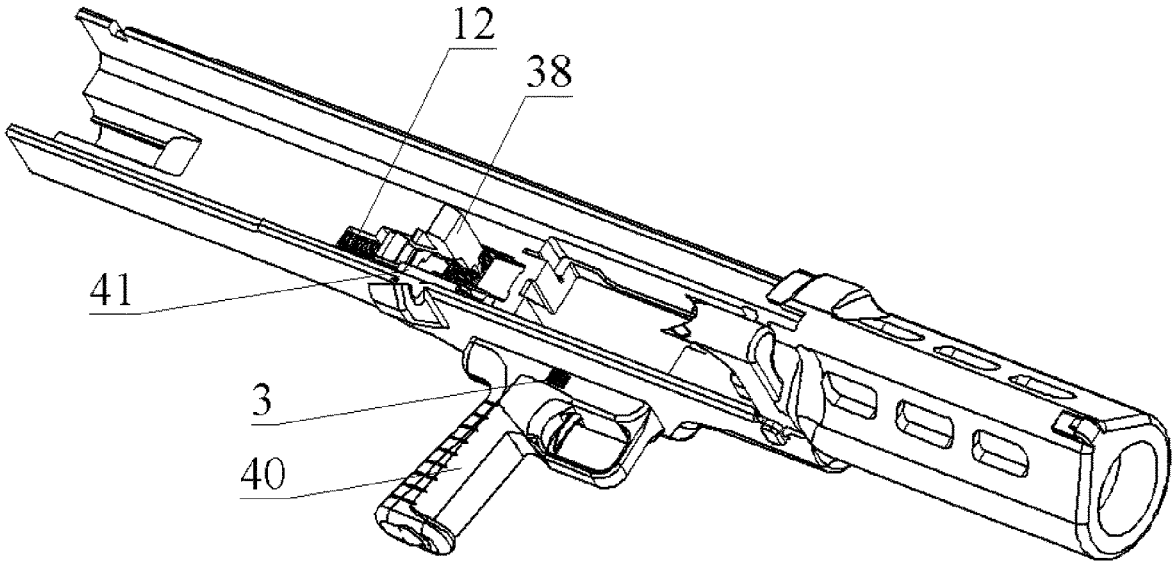
FIG. 7 and FIG. 7A show the use of the proposed mechanism for weapons, made in the embodiment with the side handle of firing (side view)

FIG. 7 shows the use of the mechanism for weapons made with a side handle firing. This configuration consists of: safety catch 3, spring 12 of the trigger bar, universal percussion mechanism 38, trigger housing 40, universal trigger mechanism 41 for semi-automatic fire for weapons with a side pistol grip.

Figure 7A:
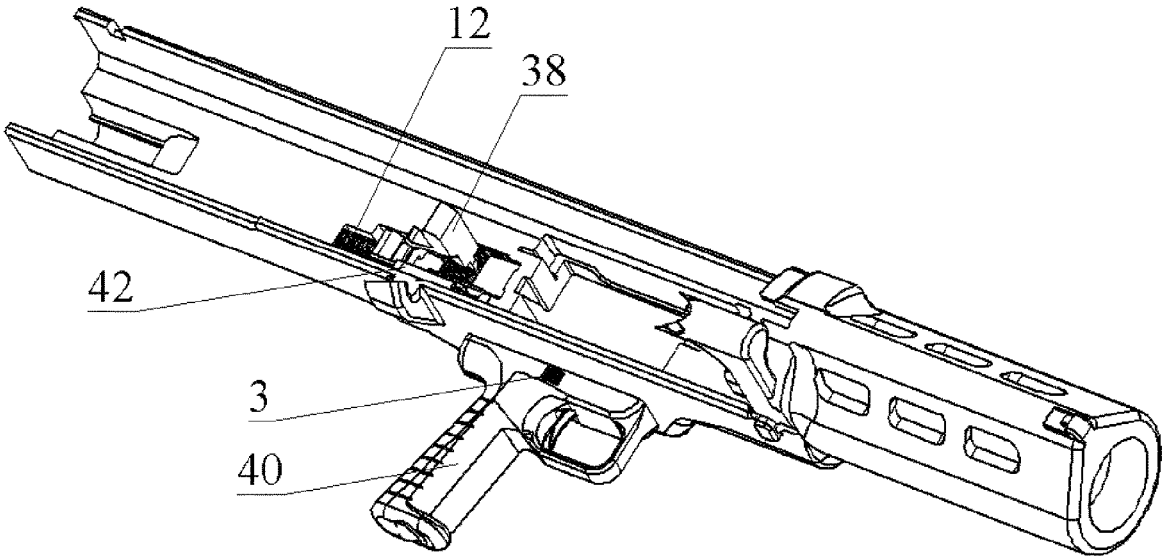

FIG. 7A shows the use of a mechanism for weapons made with a side handle firing. This configuration consists of: safety catch 3, spring of the trigger bar 12, universal percussion mechanism 38, trigger housing 40, universal trigger mechanism for semi-automatic and automatic fire 42 for weapons with side pistol grip.

Figure 8:
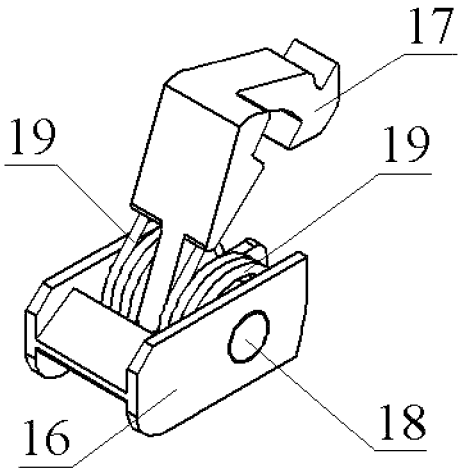
FIG. 8 shows a side view of a universal percussion mechanism 38.

FIG. 8 shows a universal percussion mechanism 38 (side view). This configuration consists of: bracket 16 for universal percussion mechanism, cocking piece 17, axis 18 of the cocking piece 17, mainsprings 19.

Figure 9:
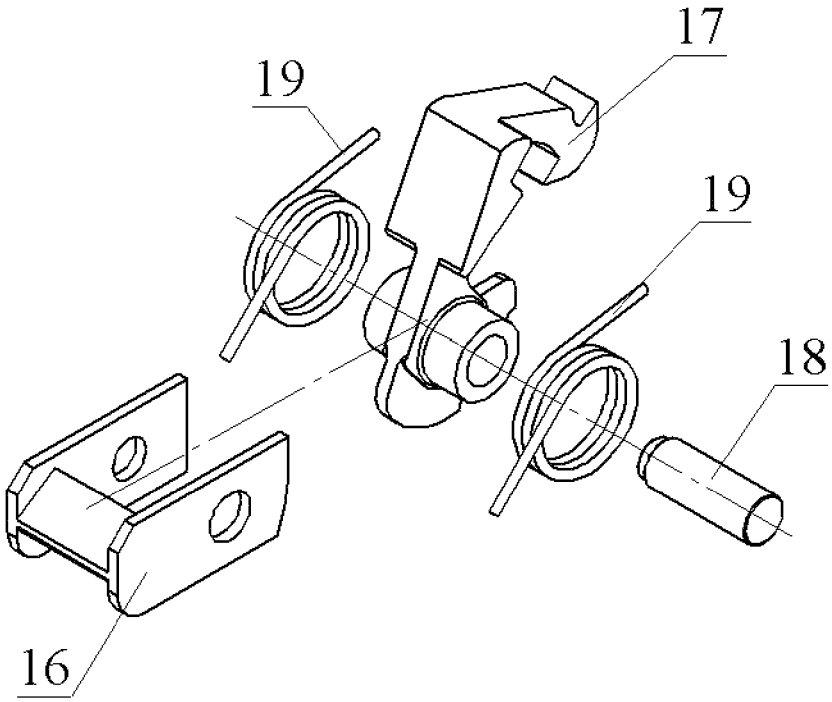
FIG. 9 shows a side view of the details of the universal percussion mechanism 38.

FIG. 9 shows the details of the universal percussion mechanism 38. This configuration consists of: bracket 16 of the universal percussion mechanism, cocking piece 17, axis 18 of the cocking piece 17, mainsprings 19.

Figure 10:
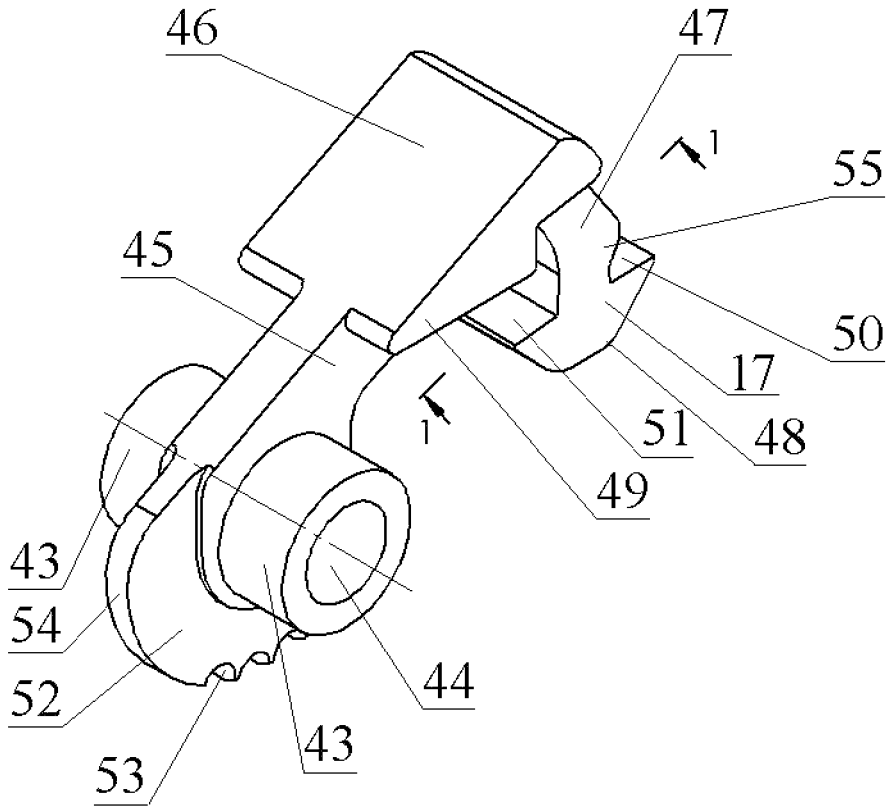
FIG. 10 shows the cocking piece 17 (side view)

FIG. 10 shows a side view of the cocking piece 17. The cocking piece 17 is made with cylindrical protrusions 43 with a through hole 44 (for the axis 18 of the cocking piece 17), base 45 of the cocking piece, percussion platform 46, tail 47 of the cocking piece and the cocking piece tip 48. On the percussion platform 46 below damper platform 49 is made. At the cocking piece tip 48 there is a protrusion with the cocking platform 50, for sear 11, and a protrusion with platform 51, for single-shot sear 27 or multifunctional switch 28. A cocking indicator 52 is made in the form of thin plate at the bottom of the base of the cocking piece 45 with notched section 53 and a smooth section 54. In the tail 47 of the cocking piece, on the bottom in front of the protrusion with cocking platform 50, a protrusion 55 is made.

Figure 11:
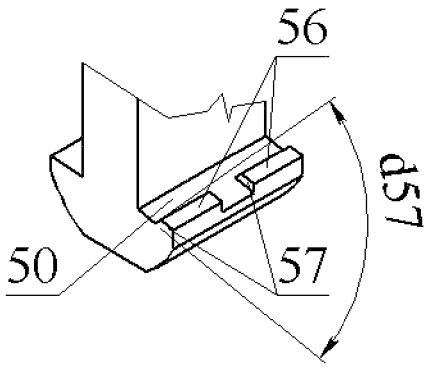
FIG. 11 shows a fragment of the cocking piece 17 for a universal percussion mechanism 38.

FIG. 11 shows a fragment of the cocking piece 17 for the universal percussion mechanism 38 (section 1-1 in FIG. 10). On the protrusion with the platform of the cocked position 50, of the cocking piece 17, the protrusion 56 is made with an inclined platform 57. The inclined platform 57 forms an acute angle d57 with the platform of the cock position platform 50, equal to 35-45 degrees, which is the optimal value to create a safety effort.

Figure 12:
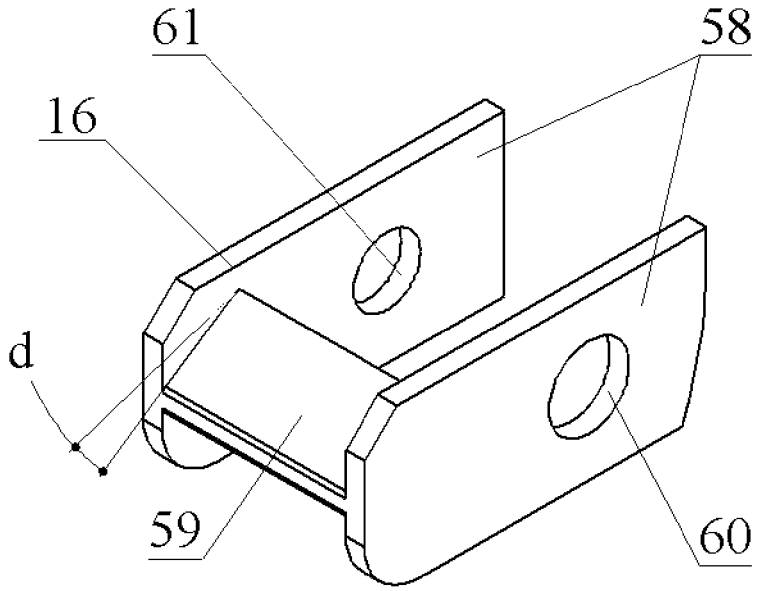
FIG. 12 shows a side view of the bracket 16 of the universal percussion mechanism 38.

FIG. 12 shows a side view of the bracket 16 of the universal percussion mechanism 38. The bracket 16 of the universal percussion mechanism 38 is made in the form of two plates 58 connected with a transverse plate 59 at an acute angle d59 relative to the horizontal axis of the bracket 16. On the plates 58 there is a hole 60 for the axis 18 of the cocking piece 17 and the hole 61 for the slot 63 of the axis 18 of the cocking piece 17.

Figure 13:
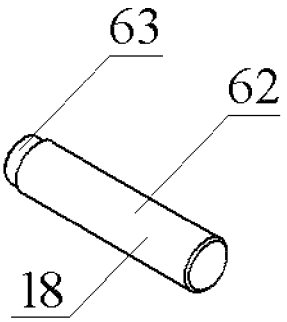
FIG. 13 shows a side view of the safety catch 3.

FIG. 13 shows a side view of the axis 18 of the cocking piece 17. The axis 18 of the cocking piece 17 is made in the form of a cylinder 62 with a slot 63 at the end.

Figure 14:
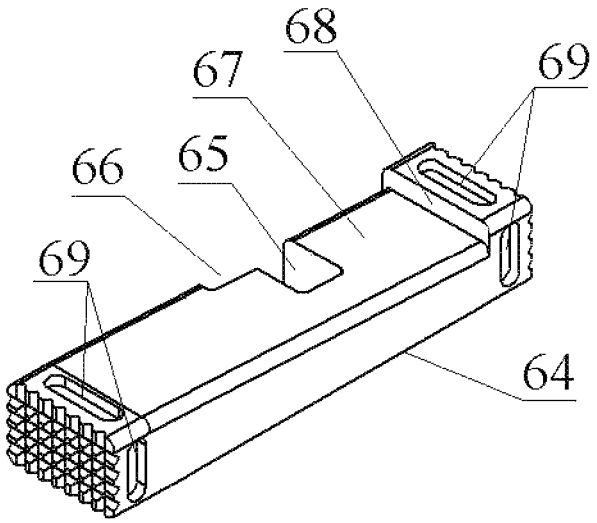
FIG. 14 and FIG. 15 show a side view and a bottom view, respectively, of the safety catch 3.
Figure 15:
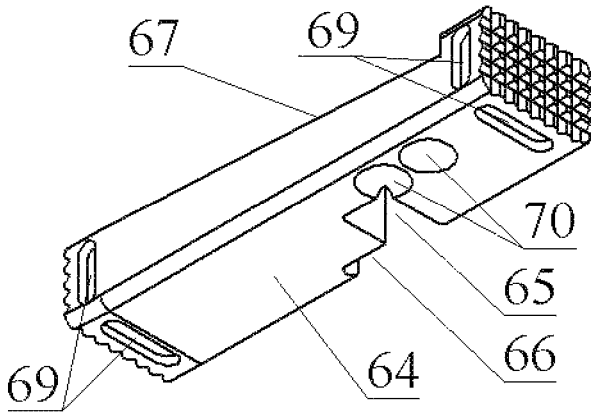

FIG. 14 shows a side view, and FIG. 15 shows a bottom view of the safety catch 3. The safety catch 3 is made in the form of a rectangular rod 64. On the side of the rectangular rod 64 a large slot 65 is made and a small slot 66 for the trigger bar 23 or 24 or 25 or 26. A through-slot 67 of a triangular shape is made on top of the rectangular rod 64. Due to the through-slot 67 of the triangular shape at the end of the rectangular rod 64, a protrusion 68 is formed. Two slots 69 are made at the ends of the rectangular rod 64 to indicate the operation mode of the safety catch 3. At the bottom the rectangular surface of the rod 64 are two spherical recesses 70 under the safety latch 4 of safety catch 3.

Figure 16:
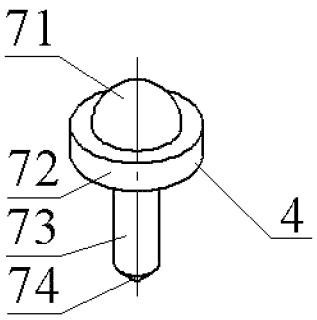
FIG. 16 shows a side view of the latch 4 of the safety catch 3.

FIG. 16 shows a side view of the safety latch 4 of the safety catch 3. The safety latch 4 of the safety catch 3 is made with a spherical head 71, which passes into a cylindrical section 72, which passes into the axis 73, and ends with a cone 74.

FIG. 17 shows a side view of the pusher 6 of the latch 7 of the magazine 1. The pusher 6 of the latch 7 of the magazine is made with a cylindrical portion 75, passing into the washer 76, which passes into the axis 77.

FIG. 18 shows a side view of the latch 7 of the magazine 1. The latch 7 of the magazine is made with a washer 78, with a lever 79 and a slot 80. In the center of the washer 78 there is a rod 81 with a locking protrusion 82 for fixing the magazine 1. Between the washer 78 and the locking protrusion 82 made another protrusion 83 for the latch magazine pusher 6.

FIG. 19 shows a side view of a universal trigger mechanism 36 for semi-automatic fire for weapons with a magazine in a pistol grip or weapons made according to the bull-pup scheme, which consists of a trigger bar 23 for a universal trigger mechanism 36 for semi-automatic fire, a single-shot sear 27, sear 11, spring 30 of the trigger mechanism.

FIG. 19A shows a side view of the universal trigger mechanism 41 for semi-automatic fire for weapons with a side pistol grip, which consists of: trigger bar 25 for the universal trigger mechanism 41 for semi-automatic fire for weapons with a side pistol grip, a single-shot sear 27, sear 11, spring 30 of the trigger mechanism.

FIG. 20 shows a detail of a universal trigger mechanism 36 for semi-automatic fire for weapons with a magazine in a pistol grip or weapons made according to the bull-pup scheme, which consists of: trigger bar 23 for a universal trigger mechanism 36 for semi-automatic fire, a single-shot sear 27, sear 11, spring 30 of the trigger mechanism.

FIG. 20A shows a detail of a universal trigger mechanism 41 for semi-automatic fire for weapons with a side pistol grip, which consists of: trigger bar 25 for trigger mechanism 41 for semi-automatic fire for weapons with a side pistol grip, a single-shot sear 27, sear 11, spring 30 of the trigger mechanism.

FIG. 21 shows a side view of a universal trigger mechanism 37 for semi-automatic and automatic fire for weapons with a magazine in a pistol grip or weapons made according to the bull-pup scheme, which consists of: trigger bar 24 for universal trigger mechanism 37 for semi-automatic and automatic fire, sear 11, multifunctional switch 28, axis 29 of the multifunctional switch 28, spring 30 of the trigger mechanism.

FIG. 21A shows a side view of the universal trigger mechanism 42 for semi-automatic and automatic fire for weapons with a side pistol grip, which consists of: trigger bar 26 for a universal trigger mechanism 42 for semi-automatic and automatic fire for weapons with a side pistol grip, sear 11, multifunctional switch 28, axis 29 of multifunctional switch 28, spring 30 of the trigger mechanism.

FIG. 22 shows a detail of the universal trigger mechanism 37 for semi-automatic and automatic fire for weapons with a magazine in a pistol grip or weapons made according to the bull-pup scheme, which consists of: trigger bar 24 for a universal trigger mechanism 37 for semi-automatic and automatic fire, sear 11, multifunctional switch 28, axis 29 of multifunctional switch 28, spring 30 of the trigger mechanism.

FIG. 22A shows a detail of the universal trigger mechanism 42 for semi-automatic and automatic fire for weapons with a side pistol grip, which consists of: trigger bar 26 for a trigger mechanism for semi-automatic and automatic fire for weapons with a side pistol grip 42, sear 11, multifunctional switch 28, axis 29 of multifunctional switch 28, spring 30 of the trigger mechanism.

FIG. 23 shows a side view of the trigger bar 23. The rod is made with the trigger 84, the safety protrusion 85. On the trigger 84 a front protrusion 86 is located, along with the base of the trigger 87, which is connected with the thrust 89. The thrust 89 can be made with different length, which allows to use the trigger bar 23 for weapons with a magazine in the pistol grip and weapons made according to the "bull-pup" scheme without additional details. The thrust 89 passes into the bar 90, inside which a rectangular cavity 91 is made for a single-shot sear 27. The bar 90 is connected with the protrusion 92, which is connected with the rear protrusion 93. The rear protrusion 93 is designed to install the sear 11.

FIG. 24 shows a side view of the trigger bar 24. The trigger bar 24 is designed as a trigger bar 23, but in the upper portion of the bar 90, there is a rectangular hole 94 for the rack 111 and the horizontal protrusion 112, the multifunctional switch 28. A figured slot 95 is made at the bottom of the rectangular cavity 91 for the passage of the protrusion 114 of the multifunctional switch 28. The rectangular hole 94 and the figured slot 95 are designed to use the semi-automatic and automatic fire mode. The thrust 89 can be made in various lengths, which allows the use of the trigger bar 24 for weapons with a magazine in the pistol grip and weapons made according to the bull-pup scheme without additional details.

FIG. 25 shows a side view of the trigger bar 25. The trigger bar 25 with a trigger is designed as a trigger bar 23, but differs in that, in the trigger section 84, it is made in a horizontal plane, which allows the trigger bar 25 for weapons made with side handle firing.

FIG. 26 shows a side view of the trigger bar 26. The trigger bar 26 with the trigger is made as a trigger bar 24 but differs in that in the trigger section 84 is made in a horizontal plane, which allows to use the trigger bar 26 for weapons made with side handle firing.

FIG. 27 shows a side view of the sear 11. The sear 1 comprises a bar 96, in front of which a protrusion 97 is made. At the bottom of the protrusion 97 there is a support platform 98 of the sear 11. A side of the sear 11 has a through hole 99 for the rear protrusion 93 for the trigger bar 23 or 24 or 25 or 26. The upper surface of the protrusion 97 is made in the form of a radius. On the back wall of the bar 96 with the bottom edge there is a locking protrusion 100, designed to fix the universal trigger mechanism 36 or 41 when installing weapons in the trigger housing 22, which facilitates the assembly of weapons.

FIG. 28 shows a bottom view of the sear 11 for cocking pieces with a safety. For trigger mechanisms with a safety in the sear 11 on the support platform 98, it sear, a T-shaped protrusion 101 with an inclined platform 102 is made. The inclined platform 102 forms an acute angle d102 with a sear support platform 98 equal to 35-45 degrees, which is the optimal value for creating safety efforts.

FIG. 29 shows a side view of the single-shot sear 27. The single-shot sear 27, contains a square rod 103. On the back of the square rod 103 a T-shaped protrusion is made, consisting of a section 104 of the sear and the rack 105 of the sear. Inside the square rod 103 there is a blind hole 106 for the spring of the trigger mechanism 30.

FIG. 30 shows a cross-section along A-A of the single-shot sear 27 (see FIG. 29). This configuration is made in the form of portion of a square rod 103 and section 104 sears having a lower horizontal surface 107, front vertical surface 108 and a rear radius surface 109.

FIG. 31 shows a side view of the multifunctional switch 28. The multifunctional switch 28 contains a trapezoidal bar 110, the front end of the indicated trapezoidal bar 110 is made in the form of a rack 111 with a horizontal protrusion 112. In the rear of the trapezoidal bar 110 a T-shaped protrusion is made, consisting of the sear section 113 and the sear rack 105. Inside the trapezoid bar 110, a blind hole 106 was made for the spring of the trigger mechanism 30 and the axis of the multifunctional switch 29. On the rear bottom surface of the trapezoidal bar 110 a protrusion is made, 114, acting as a fire lever.

FIG. 32 shows a cross-section A-A through the sear section 113 (see FIG. 31) for the multifunctional switch 28. This configuration is made as portion of the trapezoid bar 110 and the sear section 113 having the lower inclined surface 115, the front vertical surface 108 and a back radius surface 109.

FIG. 33 shows a side view of the axis 29 of the multifunctional switch 28. The axis of the multifunctional switch 29 is made with a conical section 116 with a spherical head 117, which passes into cylindrical portion 118, which passes into cylindrical portion 119 with a smaller diameter, which ends with a chamfer 120.

The operation of the latch 7 of the magazine 1 in a fixed position is shown in FIG. 34, FIG. 35 (section 1-1 in FIG. 34), FIG. 36 (section 2-2 in FIG. 34). When the magazine 1 is inserted into the corresponding cavity of the trigger housing 22, the safety latch spring 5 presses on the pusher 6 of the latch 7 of the magazine 1, which pushes the protrusion 83 of the latch 7 of the magazine 1 with its axis 77. In addition, the latch 7 of the magazine 1 rotates and engages with its locking protrusion 82 meshing with the locking protrusion 2 of the magazine 1. The latch 7 of the magazine 1 is fixed by the trigger bracket 121 of the trigger housing 22, thereby effectively fixing the magazine 1 inside the weapon. In this case, a gap B4 is formed between the upper end of the cylindrical portion 75 of the pusher of the magazine latch 6 and the lower surface of the cylindrical section 72 of the safety latch 4.

When the safety catch 3 is pressed, the spherical head 71 of the safety latch 4 is in the spherical recess 70 in the compressed state using the spring 5 of the safety latch 4. In this case, the trigger bar 23 or 24 or 25 or 26 prevents the safety catch 3 from falling out of the trigger housing 22. The safety protrusion 85 of the trigger bar 23 or 24 or 25 or 26 has the possibility to move in the large slot 65 of the safety catch 3. This makes it possible to fire a shot when the cocking piece 84 of the trigger bar 23 or 24 or 25 or 26 is pressed.

FIG. 37, FIG. 38 (Section 1-1 in FIG. 37), FIG. 39 (Section 2-2 in FIG. 37), show the operation of the latch 7 of the magazine 1 when pressed. When the magazine 1 is removed or inserted into the corresponding cavity of the trigger housing 22, then the latch 7 of the magazine 1 is fully pressed, the protrusion 83 presses the pusher 6, which compresses the safety latch spring 5. At this time, the locking protrusion 82 on the latch 7 comes out from engagement with the locking protrusion 2 of the magazine 1 and the magazine 1 can be removed from the corresponding cavity of the trigger housing 22. The latch 7 of the magazine 1 is designed for both the right and left hands of the user. Since the latch 7 of the magazine 1 is in a spring-loaded state, the safety latch spring 5, and does not protrude from the trigger housing 22, it is protected from accidental emissions. The protrusion 83 of the latch 7 of the magazine 1 is rotated by a certain angle due to the fact that the upper end of the cylindrical portion 75 of the magazine pusher 6 abuts against the lower surface of the cylindrical section 72 of the latch 4 of the safety catch 3, which does not allow the latch 7 of the magazine 1 to spontaneously. At the same time, there is no gap B4 between the upper end of the cylindrical portion 72 of the magazine pusher 6 and the lower surface of the cylindrical section 69 of the safety latch 4.

When the safety catch 3 is triggered, the spherical head 71 of the safety latch 4 is located in the spherical recess 70 and, under the action of the safety latch 4 spring 5, lifts the end of the safety catch 3. Due to the through slot of the triangular shape 67 of the safety catch 3, a protrusion 69 is formed at the end of the safety catch 3, which abuts against the trigger housing 22 and does not allow direct pressure on the safety catch 3 to remove from the safety position. In this case, the trigger bar 23 or 24 or 25 or 26 does not allow the safety catch 3 to fall out of the trigger housing 22. Moreover, the safety protrusion 85 of the trigger bar 23 or 24 or 25 or 26 does not have the possibility to move in the small slot 66 of the safety catch 3. This does not allow you to press on the trigger bar 23 or 24 or 25 or 26 and fire. To remove safety catch 3 from the safety position, safety catch 3 must be lowered down and pressed down. When the trigger bar 23 or 24 or 25 or 26 is removed, the safety catch 3 is disassembled by pushing it from the landing hole of the trigger housing 22 in any direction.

FIGS. 40 and 41 show the disassembly and assembly of the magazine latch 7. When the receiver 20 is removed from the trigger housing 22 and the safety catch 3 is removed, the safety latch 4, the pusher spring 5 with the magazine pusher 6 are removed one bar from the blind hole 122 of the trigger housing 22. Then the latch 7 of the magazine 1 is pressed down until it stops. In this case, the locking protrusion of the magazine 82 and the protrusion of the magazine 83 on the latch 7 of the magazine are installed opposite the through hole 123 in the corresponding cavity of the trigger housing 22, and the latch 7 of the magazine 1 is removed. In the proposed invention, the latch 7 of the magazine 1 is disassembled without special tools. To assemble the latch 7 of the magazine 1, the disassembling steps are reversed.

FIGS. 42 and 43 show the cocking indication of the cocking piece 17. When the cocking 17 is cocked, the cocking indicator 52 of the cocking piece 17 passes through its notched section 53 through the slot 124 with the opening of the trigger housing 22. The notched section 53 allows to determine the cocking piece 17 cocked position visually and to the touch. When the cocking piece 17 is lowered, a smooth section 54 of the cocking indicator 52 appears in the slot with the hole 124 of the trigger housing 22. The smooth section 54 of the cocking indicator 52 allows to determine the lowered position of the cocking piece 17 visually and by touch.

FIG. 44 shows a side view of a fragment of a longitudinal section of the mechanism of the adjusting screw 13. Adjusting the compression force of the cocking piece of the spring 12 of the trigger bar: by adjusting the screw 13 in the threaded stop 125 of the receiver 20, it is possible to adjust the compression force of the spring of the trigger bar 12. After setting the required compression force of the spring of the trigger bar 12, the adjusting screw 13 must be locked with the lock nut 14 of the adjusting screw, thereby preventing the force of the spring of the trigger bar 12 from changing during operation.

FIG. 45, FIG. 46 and FIG. 47 show the operation of the cocking piece 17 and sear 11 in the safety mode from an arbitrary cocking. When the trigger bar 23 or 24 or 25 or 26 is pressed, sear 11 moves and selects the gap of free thrust of the trigger bar 23 or 24 or 25 or 26 with a trigger. Further, the T-shaped protrusion 101 with the inclined platform 102 on the sear 11 abuts against the protrusion 56 with the inclined platform 57 on the cocking piece 17. In order to pass the sear 11 further, it is necessary to increase the force of pressing the trigger bar 23 or 24 or 25 or 26. This occurs due to the fact that the sear 11, with its T-shaped protrusion 101, needs to overcome the protrusion 56 on the cocking piece 17. The angle d102 of the inclined platform 102 on the sear 11 and the angle d57 of the inclined platform 57 on the cocking piece 17 are made the same, and changing their inclination is possible, adjust the safety force. After overcoming the T-shaped protrusion 101 of the protrusion 56 is the breakdown of the cocking piece 17 and the shot.

FIG. 48 shows the operation of the safety catch 3 in the position of safety against arbitrary cocking. When the safety catch 3 is in the position of safety against arbitrary cocking, the trigger bar 23 or 24 or 25 or 26, and with it sear 11, does not have the possibility to move. The cocking piece 17 is in the cocked position. When trying to cock a weapon, a bulge 33 at the rear end of the lock frame 31 abuts the cocking piece 17 and tries to cock it. In this case, the protrusion 55 on the cocking piece 17 abuts against the protrusion 97, sears 11 and bars the further movement of the lock frame 31, thereby preventing the weapon from cocking.

FIG. 49, FIG. 50, FIG. 51, and FIG. 52 show the operation of the multifunctional switch 28. To switch from an automatic fire mode to a semi-automatic fire mode, the protrusion 114 of the multifunctional switch 28 is pushed fully forward, up and back, with a horizontal protrusion 112 passes into the rectangular hole 94 of the trigger bar 24 or 26. Then, the horizontal protrusion 112 of the multifunctional switch 28 passes forward and down. In addition, the horizontal protrusion 112 will take a lower position in the rectangular cavity 91 of the trigger bar 24 or 26 and the rack 111 of the multifunctional switch 28 will disengage from the hook-shaped protrusion 32 of the lock frame 31. The spring 30 of the trigger mechanism is fully compressed and the axis 29 of the switch 28 is in the lowest position. Then the horizontal protrusion 112 will take a position in the rectangular cavity 91 of the trigger bar 24 or 26. To switch from the semi-automatic fire mode to the automatic fire mode, you need to do all of the above, the above steps in reverse order. Multifunctional switch 28 improves fire efficiency and accuracy because switching fires can be done without looking away from a gun's sight with the right or left hand arrow.

Considering the above, examples of the proposed universal percussion trigger mechanism may be as follows:

FIG. 53, FIG. 54, FIG. 55, and FIG. 56 show the operation of the universal percussion trigger mechanism for semi-automatic fire. When pressing the trigger bar 23 or 25, it presses on the sear 11 and the support platform 98 of the sear slides from the cocking platform 50 of the cocking piece 17. In this position, the spring 12 of the trigger bar 23, 25 and the mainsprings 19 are in maximum load mode. Under the action of the mainsprings 19, the cocking piece 17 is rotated. At the same time, with its percussion platform 46 it strikes the firing pin 8. Then the firing pin 8 compresses the spring 9 of the firing pin 8 and pierces the capsule with an ammunition igniter. A shot is taking place. At such a moment, the lock frame 31 rolls back and a bulge 33 at the rear end of the lock frame 31 cocks the cocking piece 17. The tip 48 of the cocking piece hits the rear radius surface 109 of the single-shot sear 27 and pushes the single-shot sear 27, compressing the spring 30 of the trigger mechanism. The protrusion with the platform 51 of the cocking piece 17 becomes on the lower horizontal surface 107 of the single-shot sear 27 and holds the cocking piece 17, in cocked position with the trigger bar 23 or 25 being pressed. The lock frame 31 reaches the extreme rear position. The returnable spring 34 will acquire maximum compression and begins to expand along the guide rod 35 of the returnable spring 34, while pushing the lock frame 31 forward. Removing the protrusion from the platform 51 of the cocking piece 17 from the lower horizontal surface 107 of the single-shot sear 27, will not happen. To perform the next shot, it is necessary to trigger the trigger bar 23 or 25. In this case, under the action of the pull the spring 12 of the trigger bar 23, 25, the trigger bar 23 or 25 will move forward with the single-shot sear 27 and sear 11. The protrusion with the platform 51 of the cocking piece 17 will disengage from the bottom horizontal surface 107 of the single-shot sear 27. The protrusion with the platform 51 of the cocked position 50 of the cocking piece 17, will go into the sear support platform 98 and will be on the cocked cocking. For firing the next shot, it is required to press and trigger the trigger bar 23 or 25.

FIG. 57, FIG. 58, FIG. 59, and FIG. 60 show the operation of the universal trigger mechanism for semi-automatic and automatic fire in the semi-automatic fire mode. When pressing the trigger bar 24 or 26, it presses on the sear 11 and the sear support platform 98 slides from the cocking platform 50 of the cocking piece 17. In this position, the spring of the trigger bar 12 and the mainsprings 19 are in maximum load mode. Under the action of the mainsprings 19, the cocking piece 17 rotates. At the same time, with its cocking piece platform 46, it strikes the firing pin 8. Then the firing pin 8 compresses the spring 9 of the firing pin and pierces the capsule with an ammunition igniter. A shot is taking place. At such a moment, the lock frame 31 rolls back and the bulge 33 at the rear end of the lock frame 31 rolls the cocking piece 17. The cocking piece tip 48 hits the rear radius surface 109 of the multifunctional switch 28 and pushes the multifunctional switch 28, compressing the spring of the trigger mechanism 30. The protrusion with the platform 51 of the cocking piece 17 becomes on the lower inclined surface 115 of the multifunctional switch 28 and holds the cocking piece 17 in the cocked position with the trigger bar 24 or 26 pressed. The lock frame 31 reaches its extreme rear position. The returnable spring 34 gains maximum compression and begins to expand along the guide rod 35 of the returnable spring 34, pushing the lock frame 31 forward. In this case, the lock frame 31, with its hook-shaped protrusion 32, will pass over the rack 111 of the multifunctional switch 28. Removing the protrusion from the platform 51 of the cocking piece 17 from the lower inclined surface 115 of the multifunctional switch 28 will not occur. To perform the next shot, it is required to release the trigger bar 24 or 26. In this case, under the influence of the spring 12 of the trigger bar, the trigger bar 24 or 26 move forward with the multifunctional switch 28 and sear 11. The protrusion with the platform 51 of the cocking piece 17 is disengaged from the lower inclined surface 115 of the multifunctional switch 28, and the protrusion with the platform of the cocked position 50 of the cocking piece 17, will pass into the sear support platform 98 and will be on the cocked cocking. For firing the next shot, it is required to release and press the trigger bar 24 or 26.

FIG. 61, FIG. 62, FIG. 63, and FIG. 64 shows the operation of the universal percussion trigger mechanism for semi-automatic and automatic fire in automatic fire mode. When pressing the trigger bar 24 or 26, it presses on the sear 11 and the sear support platform 98 slides from the cocking platform 50 of the cocking piece 17. In this position, the traction spring 12 with a trigger and the mainsprings 19 are in maximum load mode. Under impact ofthe mainsprings 19, the cocking piece 17 is rotated, while its percussion platform 46 strikes the firing pin 8. Then the firing pin 8 compresses the spring 9 of the firing pin 8 and pierces the capsule of igniter ammunition. A shot occurs. At such a moment, the lock frame 31 rolls back and a bulge 33, at the rear end of the lock frame 31, cocks the cocking piece 17. The cocking piece tip 48 hits the rear radius surface 109 of the multifunctional switch 28 and pushes the multifunctional switch 28, compressing the spring of the trigger mechanism 30 of the percussion trigger mechanism. The protrusion with the platform 51 of the cocking piece 17, becomes on the lower inclined surface 115 of the multifunctional switch 28 and holds the cocking piece 17 in the cocked position with the trigger bar 24 or 26 being pressed. The lock frame 31 reaches its extreme rear position. The returnable spring 34 gains maximum compression and begins to expand along the guide rod 35 of the returnable spring 34, pushing the lock frame 31 forward. In this case, the lock frame 31, with its hook-shaped protrusion 32, engages with the rack 111 of the multifunctional switch 28. With further forward movement of the lock frame 31, the lower inclined surface 115, of the multifunctional switch 28, disengages from the protrusion with the platform 51 of the cocking piece 17. Mainsprings 19 unclench and turn the cocking piece 17, which strikes the firing pin 8 with its percussion platform 46. The firing pin 8 compresses the firing pin's spring 9 and pierces the capsule of the ammunition igniter. Another shot occurs. If the trigger bar 24 or 25 is in the pressed position, automatic firing will continue until the ammunition runs out in magazine 1.

The proposed design of the percussion trigger mechanism was implemented on test models for weapons with a magazine in the pistol grip, for weapons made according the bullpup scheme and for weapons made with a side handle, and showed the ease of use, the ability to adjust the trigger force and prevent accidental fire.

The invention claimed is:

1. A universal percussion trigger mechanism comprising:

a safety mechanism housed in a trigger housing (22) and comprising a safety catch (3) that is slidably mounted in the trigger housing (22), a safety latch (4) that is configured to interact with the safety catch (3), a magazine pusher (6) that is coupled to the safety latch (4), and a first spring (5) that spring-loads the safety catch (3);

a magazine latch (7) that is configured to interact with the safety mechanism, the magazine latch (7) being rotatably mounted onto the trigger housing (22) and being spring-loaded by the first spring (5) via the magazine pusher (6);

a firing mechanism housed in a shutter housing (15) and comprising a firing pin (8) that is slidably mounted in the shutter housing (15), a second spring (9) that spring-loads the firing pin (8), and a firing pin locker (10) that is configured to fix a position of the firing pin (8), the firing pin (8) being configured to slide in response to an action on a cocking piece (17);

a trigger mechanism comprising a trigger bar (23) that is slidably mounted in the trigger housing (22), a sear (11) that is removably coupled to the trigger bar (23), a single-shot sear (27) or a multifunctional switch (28) that is inserted into a complementary cavity in the trigger bar (23) and that is spring-loaded by a third spring (30), and a fourth spring (12) that is fixed to the trigger housing (22) and that is configured to act on the sear (11) in order to slide the trigger bar (23) in the trigger housing (22);

a percussion mechanism housed in a receiver (2) and comprising a bracket (16), the cocking piece (17) that is coupled to the bracket (16) via a cocking indicator (18), and a mainspring (19) that spring-loads the cocking piece (17), the cocking piece (17) being configured to interact with a bulge (33) of the lock frame (31), the sear (11), and the single-shot sear (27), wherein the safety catch (3) comprises:

a rectangular rod (64), a large slot (65) and a small slot (66) in the rectangular rod (64) that are configured to interact with a safety protrusion (85) of the trigger bar (23), a through triangular slot (67) in the rectangular rod (64), a first protrusion (68) at one of two longitudinal ends of the rectangular rod (64), the first protrusion (68) being configured to interact with the trigger housing (22), two slots (69) at the two longitudinal ends of the rectangular rod (64), and two spherical recesses (70) in a surface of the rectangular rod (64), the two spherical recesses (70) being configured to interact with the safety latch (4), wherein the safety latch (4) comprises:

a first spherical head (71) that is configured to interact with the two spherical recesses (70) of the safety catch (3), a first cylindrical portion (72) connecting the first spherical head (71) to a safety latch axis (73), and a conical end (74) at an end of the safety latch axis (73) opposite from the first spherical head (71);

wherein the magazine latch (7) comprises:

a first washer (76), a pair of levers (79) separated by a slot (80), one of the pair of levers (79) being connected to the first washer (76), a rod (81) projecting from a center of the first washer (76), wherein the rod (81) rotatably mounts the magazine latch (7) onto the trigger housing (22), and wherein the rod (81) comprises a first locking protrusion (82) configured to interact with a complementary second locking protrusion (2) of a magazine (1), and a second protrusion (83) that is disposed between the first washer (76) and the first locking protrusion (82) and that is configured to interact with the magazine pusher (6), wherein the magazine pusher (6) comprises:

a second cylindrical portion (75), and a second washer (78) connecting the second cylindrical portion (75) to a magazine pusher axis (77);

wherein the safety latch (4) and the magazine pusher (6) are arranged so that a gap (B4) is formed between the first cylindrical portion (72) of the safety latch (4) and the second cylindrical portion (75) of the magazine pusher (6);

wherein the cocking piece (17) comprises:

a first base (45) the first base (45) comprising a cocking indicator (52) that is a thin plate with a notched section (53) and a smooth section (54), a pair of cylindrical protrusions (43) on either side of the first base (45), a first through hole (44) extending through the pair of cylindrical protrusion (43), a cocking piece percussion platform (46) that is configured to interact with the firing pin (8) and the bulge (33) of the lock frame (31), a lower surface of the cocking piece percussion platform (46) defining a damper platform (49) that is configured to interact with the receiver (20), a cocking piece tail (47) and a cocking piece tip (48) that are configured to interact with an upper surface of a third protrusion (97) of the sear (11) and a rear radius surface (109) of the single-shot sear (27), the cocking piece tip (48) comprising a first platform (50) that is configured to interact with a support platform (98) of the sear (11), and a second platform (51) that is configured to interact with a lower horizontal surface (107) of the single-shot sear (27), and the cocking piece tail (47) comprising a fourth protrusion (55) that extends toward the first platform (50), and that is configured to interact with the third protrusion (97) of the sear (11);

wherein the sear (11) comprises:

a first bar (96), the third protrusion (97) extending from a front of the first bar (96), a bottom surface of the third protrusion (97) defining the support platform (98) of the sear (11) and an upper surface of the third protrusion (97) defining an arc, and a second through hole (99) is formed in the first bar (96) behind the third protrusion (97), a locking protrusion (100) extending from a rear bottom edge of the first bar (96);

wherein the single-shot sear (27) comprises:

a block (103), a first T-shaped protrusion extending from a rear portion of the block (103), the first T-shaped protrusion comprising a first sear section (104) and a first sear rack (105), a first blind hole (106) that is formed inside the block (103) and is configured to house the third spring (30) of the trigger mechanism:

wherein the bracket (16) comprises:

two plates (58) connected with a transverse plate (59) at an acute angle (d59) relative to a horizontal axis of the bracket (16), and a pair of holes (60, 61) formed on the two plates (58), the pair of holes (60, 61) having different diameters;

wherein the cocking indicator (18) comprises a cylindrical body (62) and a slot (63) at one end of the cylindrical body (62), and wherein the cocking indicator (18) is mounted in the pair of holes (60, 61) of the bracket (16), wherein the trigger bar (23) comprises:

a trigger (84)

the safety protrusion (85) that extends from a surface of the trigger (84) and that is configured to interact with the safety catch (3), a front protrusion (86) that extends from a surface of the trigger (84) opposite from the safety protrusion (85) and that is configured to interact with the trigger housing (22), and a second base (87) connected to the trigger (84)

a thrust (89) connected to the second base (87), a second bar (90) connected to the thrust (89), the second bar (90) comprising the cavity (91) into which the single-shot sear (27) is inserted, and a fifth protrusion (92) connected to a rear protrusion (93), the sear (11) being removably mounted on the rear protrusion (93);

wherein the multifunctional switch (28) comprises:

a trapezoidal bar (110), a rack (111) that is disposed at a front end of the trapezoidal bar (110), and that is configured to interact with a hook-shaped protrusion (32) of the lock frame (31), a horizontal protrusion (112) that extends from the rack (111), and that is configured to interact with the receiver (20), and a second T-shaped protrusion that extends from a rear portion of the trapezoidal bar (111), the second T-shaped protrusion comprising a second sear section (113) and a second sear rack (105), a second blind hole (106) that is formed inside the trapezoidal bar (110) and that is configured to house a multifunction switch axis (29) that is spring-loaded by the third spring (30) of the trigger mechanism, and a sixth protrusion (114) that extends from a rear bottom surface of the trapezoidal bar (111), and that is configured as a lever of fire;

wherein the multifunctional switch axis (29) comprises:

a second spherical head (117), a conical section (116) connected to the second spherical head (117), a third cylindrical portion (118) connected to the conical section (116), a fourth cylindrical portion (119) connected to the third cylindrical portion (118), the fourth cylindrical portion (119) having a smaller diameter than the third cylindrical portion (118), and a chamfer (120) connected to the fourth cylindrical portion (119).

2. The universal percussion trigger mechanism according to claim 1, wherein a rectangular hole (94) is formed in an upper portion of the second bar (90), and a figured slot (95) is formed in the cavity (91), wherein the multifunctional switch (28) is located in the cavity (91), and wherein the multifunctional switch (28) is configured to reciprocate and roll relative to a rear portion of the cavity (91).

3. The universal percussion trigger mechanism according to claim 2, wherein the trigger bar (24) is mounted in the trigger housing (22) so that the trigger housing (22) is configured as a pistol grip that houses a magazine.

4. The universal percussion trigger mechanism according to claim 2, wherein the trigger bar (24) is mounted in the trigger housing (22) according to a bull-pup scheme (39).

5. The universal percussion trigger mechanism according to claim 1, wherein the first base of the cocking piece functions as the second base of the trigger bar, and wherein the first base of the cocking piece is rotated by 90 degrees and is located in a vertical plane.

6. The universal percussion trigger mechanism according to claim 5, wherein the trigger bar (25) is mounted in the trigger housing (22) so that the trigger housing (22) is configured as a side pistol grip (40).

7. The universal percussion trigger mechanism according to claim 1, wherein a rectangular hole (94) is formed in an upper portion of the second bar (90), and a figured slot (95) is formed in the cavity (91), wherein the multifunctional switch (28) is located in the cavity (91), wherein the multifunctional switch (28) is configured to reciprocate and roll relative to a rear portion of the cavity (91), wherein the first base of the cocking piece functions as the second base of the trigger bar, and wherein the first base of the cocking piece is rotated by 90 degrees and is located in a vertical plane.

8. The universal percussion trigger mechanism according to claim 7, the trigger bar (26) is mounted in the trigger housing (22) so that the trigger housing (22) is configured as a side pistol grip (40).

9. The universal percussion trigger mechanism according to claim 1, wherein the trigger bar (23) is mounted in the trigger housing (22) so that the trigger housing (22) is configured as a pistol grip that houses a magazine.

10. The universal percussion trigger mechanism according to claim 1, wherein the trigger bar (23) is mounted in the trigger housing (22) according to a bull-pup scheme (39).

11. The universal percussion trigger mechanism according to claim 1, wherein a seventh protrusion (56) having a first inclined platform (57) extends from the first platform (50) of the cocking piece (17), and wherein a third T-shaped protrusion (101) having a second inclined platform (102) extends from the support platform (98) of the sear (11).

12. The universal percussion trigger mechanism according to claim 11, wherein the first inclined platform (57) forms a first acute angle (d57) of from 35-45° relative to the first platform (50).

13. The universal percussion trigger mechanism according to claim 12, wherein the first acute angle (d57) is equal to a second acute angle (d102) between the second inclined platform (102) and the support platform (98).

14. The universal percussion trigger mechanism according to claim 11, wherein the second inclined platform (102) forms a second acute angle (d102) of from 35-45° relative to the support platform (98) of the sear (11).

15. The universal percussion trigger mechanism according to claim 1, wherein a length of the thrust (89) is adjusted based on a manner in which the trigger bar is mounted in the trigger housing (22).

* * * * *